US010594093B2

(12) United States Patent
Lipke et al.

(10) Patent No.: US 10,594,093 B2
(45) Date of Patent: Mar. 17, 2020

(54) CONNECTOR ASSEMBLY WITH BALL JOINT INTERFACE

(71) Applicant: Leviton Manufacturing Co., Inc., Melville, NY (US)

(72) Inventors: Dean S. Lipke, Mill Creek, WA (US); Jon Clark Riley, Redmond, WA (US); Ryan C. Moore, Mill Creek, WA (US); Elizabeth G. Rasmussen, Bothell, WA (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 0 days.

(21) Appl. No.: 16/034,755

(22) Filed: Jul. 13, 2018

(65) Prior Publication Data

US 2018/0323557 A1 Nov. 8, 2018

Related U.S. Application Data

(63) Continuation of application No. 15/582,117, filed on Apr. 28, 2017, now Pat. No. 10,063,021.

(51) Int. Cl.
*H01R 13/60* (2006.01)
*H01R 35/00* (2006.01)
(Continued)

(52) U.S. Cl.
CPC ..... *H01R 24/64* (2013.01); *H01R 12/592* (2013.01); *H01R 13/567* (2013.01);
(Continued)

(58) Field of Classification Search
CPC .... H01R 35/04; H01R 35/02; H01R 13/5841; H01R 24/54; H01R 25/00; H01R 33/94; H01R 31/06
(Continued)

(56) References Cited

U.S. PATENT DOCUMENTS 2,519,933 A * 8/1950 Rouault ..... H01P 1/064
174/21 JC
5,380,219 A * 1/1995 Klier ..... H01R 13/562
439/446

(Continued)

FOREIGN PATENT DOCUMENTS

DE 4202176 7/1993

OTHER PUBLICATIONS

Written Opinion of the International Searching Authority, dated Oct. 2, 2017, received in International Patent Application No. PCT/US2017/038308.

(Continued)

*Primary Examiner* — Abdullah A Riyami
*Assistant Examiner* — Thang H Nguyen
(74) *Attorney, Agent, or Firm* — Davis Wright Tremaine LLP; George C. Rondeau, Jr.; Heather M. Colburn

(57) ABSTRACT

A connector assembly that includes an outer shell and a first communication connector. The first communication connector and/or the outer shell is/are movable about one or more degrees of freedom. The first communication connector is configured to form a first electrical or optical connection with an external communication connector. Optionally, the connector assembly includes a second communication connector. The first communication connector may be connected to a cable or the optional second communication connector by a flexible substrate positioned inside the outer shell. The first communication connector may be implemented as a fiber optic connector optically connected to either a fiber optic cable or the second communication connector, which may also be implemented as a fiber optic connector.

23 Claims, 35 Drawing Sheets

(51) Int. Cl.

| | |
|---|---|
| ***H01R 13/56*** | (2006.01) |
| ***H01R 24/00*** | (2011.01) |
| ***H01R 24/64*** | (2011.01) |
| ***H01R 12/59*** | (2011.01) |
| ***H01R 13/719*** | (2011.01) |
| *H01R 107/00* | (2006.01) |
| *H01R 35/02* | (2006.01) |
| *H01R 24/66* | (2011.01) |
| *H01R 24/76* | (2011.01) |

(52) U.S. Cl.
CPC ..... *H01R 13/719* (2013.01); *H01R 24/66* (2013.01); *H01R 24/76* (2013.01); *H01R 35/02* (2013.01); *H01R 2107/00* (2013.01)

(58) Field of Classification Search
USPC ..... 439/8, 6, 446, 638, 534, 540.1, 676
See application file for complete search history.

(56) References Cited

U.S. PATENT DOCUMENTS 5,481,607 A * 1/1996 Hsiao ..... H04M 1/15 242/385.1
5,722,842 A 3/1998 Cairns
5,738,535 A 4/1998 Cairns
5,796,047 A * 8/1998 Sheng-Hsin ..... H04M 1/15 174/135
5,873,750 A 2/1999 Cairns et al.
6,017,227 A 1/2000 Cairns et al.
6,315,461 B1 11/2001 Cairns
6,402,539 B1 6/2002 Toth et al.
6,431,912 B1 8/2002 Mori
6,484,801 B2 * 11/2002 Brewer ..... E21B 17/028 166/65.1
6,537,106 B1 * 3/2003 Follingstad ..... H01R 13/518 439/534
6,543,965 B2 * 4/2003 Toth ..... H02G 15/14 405/158
7,140,910 B1 * 11/2006 Liao ..... H01R 13/72 439/502
7,357,654 B2 * 4/2008 Lin ..... H05K 5/0278 439/164
7,478,927 B2 * 1/2009 Matthew ..... F21L 14/023 362/258
7,699,353 B2 4/2010 Smith
8,038,456 B1 * 10/2011 Wang ..... G02B 6/3893 385/56
8,157,569 B1 * 4/2012 Liu ..... H01R 35/04 439/11
8,369,513 B2 * 2/2013 Hammond, Jr. ..... H04B 3/32 379/417
8,757,929 B2 6/2014 Gutierrez et al.
9,257,805 B2 * 2/2016 Wang ..... H01R 13/447
9,327,938 B2 * 5/2016 Wilson ..... B65H 75/4402
9,477,060 B2 10/2016 Sales Casals
2002/0003931 A1 1/2002 Cairns et al.
2005/0112939 A1 * 5/2005 Grzegorzewska ... G02B 6/3825 439/534
2008/0274640 A1 * 11/2008 Siemon ..... H01R 13/6463 439/534
2012/0028505 A1 * 2/2012 Weber ..... H01R 25/003 439/638
2012/0322304 A1 * 12/2012 Taguchi ..... H01R 13/501 439/582
2013/0257374 A1 * 10/2013 Ichikawa ..... B60K 1/04 320/109
2014/0127937 A1 * 5/2014 Huang ..... H01R 35/04 439/534
2014/0235079 A1 * 8/2014 Wallace ..... H01R 35/04 439/131
2015/0093917 A1 * 4/2015 Stern ..... B25J 9/065 439/8
2015/0132974 A1 * 5/2015 Kapella ..... H01R 33/92 439/8

OTHER PUBLICATIONS

International Search Report, dated Oct. 2, 2017, received in International Patent Application No. PCT/US2017/038308.
Information Disclosure Statement Transmittal, tiled herewith.

* cited by examiner

CONNECTOR ASSEMBLY WITH BALL JOINT INTERFACE

CROSS REFERENCE TO RELATED APPLICATION(S)

This application is a continuation of U.S. patent application Ser. No. 15/582,117, filed on Apr. 28, 2017, now U.S. Pat. No. 10,063,021, titled CONNECTOR ASSEMBLY WITH BALL JOINT INTERFACE.

BACKGROUND OF THE INVENTION

Field of the Invention

The present invention is directed generally to communications connectors and more particularly to communications connectors conforming to the RJ-45 standard and fiber optic communications connectors.

Description of the Related Art

As is apparent to those of ordinary skill in the art, a communication plug (e.g., a plug configured to comply with the RJ-45 standard) is configured to be received by a corresponding communication jack or outlet (e.g., an outlet configured to comply with the RJ-45 standard). Thus, to connect two plugs or two outlets together, an intermediate connector assembly (e.g., a coupler) is needed.

It may be advantageous to connect a connector assembly permanently to one end of cable. The combined cable and connector assembly may be used to implement a wall-type outlet or similar connection. The wall-type outlet may be mounted on a wall plate or at other locations, such as in a conference table, a modular office wall, furniture, and the like.

Currently, to connect a plug (connected to a cable) to an outlet in a wall plate, the user must position the plug perpendicular to the face of the wall plate and pull the cable longitudinally to insert the plug into the outlet. This is often problematic. For example, if the outlet is in a difficult to reach location (e.g., behind another object), the user may not have sufficient space in which to position the plug perpendicular to the wall plate. Further, the plug may be accidentally disconnected from the outlet by pulling the cable in a direction other than perpendicular to the wall plate. Unfortunately, such "side-pull" can damage the connector assembly and/or wires inside the cable. Additionally, whenever a cable is connected to another structure by a plug or an outlet, the cable may bend, which can also damage the wires inside the cable.

Therefore, a need exists for new connector assemblies configured to help avoid side-pull. Connector assemblies that are mountable to wall plates are also desirable. The present application provides these and other advantages as will be apparent from the following detailed description and accompanying figures.

BRIEF DESCRIPTION OF THE SEVERAL VIEWS OF THE DRAWING(S)

Like reference numerals have been used in the figures to identify like components.

DETAILED DESCRIPTION OF THE INVENTION

Overview

Figure 1:
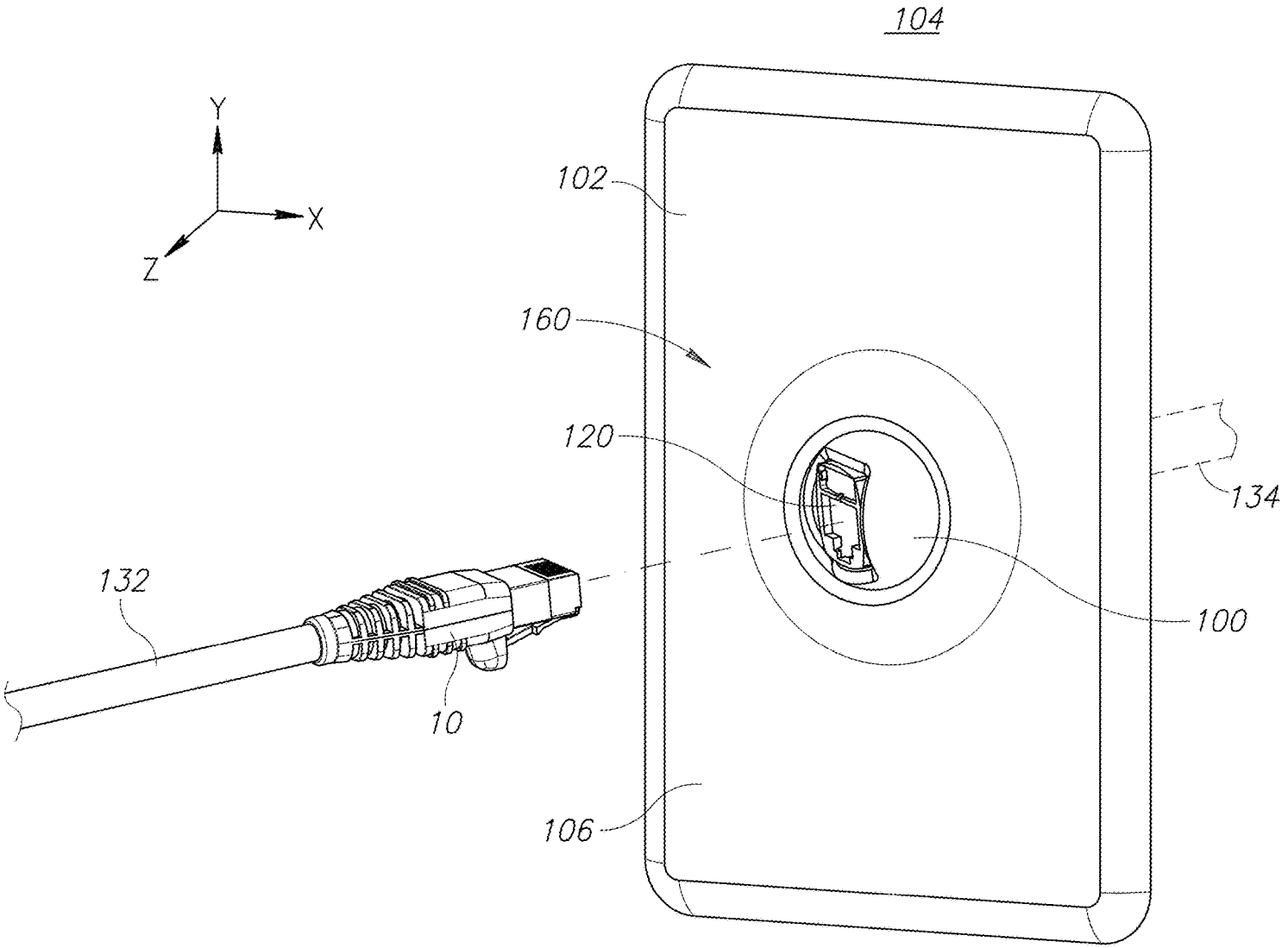
FIG. 1 is a perspective view of a front side of a first embodiment of a connector assembly mounted in a wall plate.

FIGS. 1-5, 7-23, 25, 27, and 30-41 illustrate exemplary embodiments of a connector assembly. Referring to FIG. 13, a connector assembly 400 is configured to adjust the position of a first connector 120 (e.g., a plug or an outlet) and/or a second connector 122 (e.g., a plug or an outlet) to help reduce stress on cable(s) connected to the first connector 120 and/or the second connector 122. Thus, the connector assembly may be used to position the first and/or second connectors 120 and 122 to avoid side-pull by allowing the first and/or second connectors 120 and 122 to be aligned with the pull direction.

One or both of the first and second connectors 120 and 122 may be implemented as a category 6a, RJ-45 style plug or outlet. Alternatively, one or both of the first and second connectors 120 and 122 may be implemented as a category 8, RJ-45 style plug or outlet. For example, one or both of the first and second connectors 120 and 122 may be configured to comply with the ANSI/TIA 568-C.2-1 CAT8 standard. By way of another non-limiting example, one or both of the first and second connectors 120 and 122 may be implemented as a lower category plug or outlet conforming to the category 6 standard, the category 5e standard, future standards beyond category 8, and the like. By way of another non-limiting example, one or both of the first and second connectors 120 and 122 may be implemented as another type of connector, such as a fiber optic connector, a Universal Serial Bus ("USB") connector, a High-Definition Multimedia Interface ("HDMI") connector, and the like. By way of non-limiting examples, one or both of the first and second connectors 120 and 122 may be implemented as a small form factor ("SFF") style connector (e.g., a Lucent Connector ("LC") style connector, a Mechanical Transfer Registered Jack ("MT-RJ") style connector, and the like), a Subscriber Connector ("SC") style connector, a Straight Tip ("ST") style connector, a FC style connector, a fiber distributed data interface ("FDDI") style connector, an ESCON style connector, a MU style connector, an E2000 style connector, a "fiber jack" style connector (e.g., an Opti-Jack connector manufactured by Panduit), a ribbon fiber style connector (e.g., a MT connector, a 25 MTP connector, a Multi-fiber Push-On ("MPO") connector, and the like), and the like.

First Embodiment

FIG. 1 is a perspective view of a first embodiment of a connector assembly 100 mounted inside a wall plate 102 installed in a wall 104. The wall plate 102 has a front side 106 opposite a backside 108 (see FIG. 2). For ease of illustration, a three-dimensional coordinate system has been illustrated in FIG. 1. The coordinate system includes X, Y, and Z-axes. In FIG. 1, the Y-axis is substantially vertical and the X-axis is substantially horizontal with respect to the wall plate 102. The Z-axis is substantially orthogonal to the front side 106 of the wall plate 102.

At the front side 106, the connector assembly 100 includes a first connector 120 (e.g., a plug or an outlet). In the embodiment illustrated in FIGS. 1 and 3A-5, the first connector 120 is implemented as a jack or an outlet (e.g., like an outlet 20 illustrated in FIG. 41). In such embodiments, the first connector 120 is configured to receive and form an electrical connection with a corresponding plug 10 (e.g., terminating a cable 132). In the embodiment illustrated, the plug 10 is received by the first connector 120 along the Z-axis.

Figure 2:
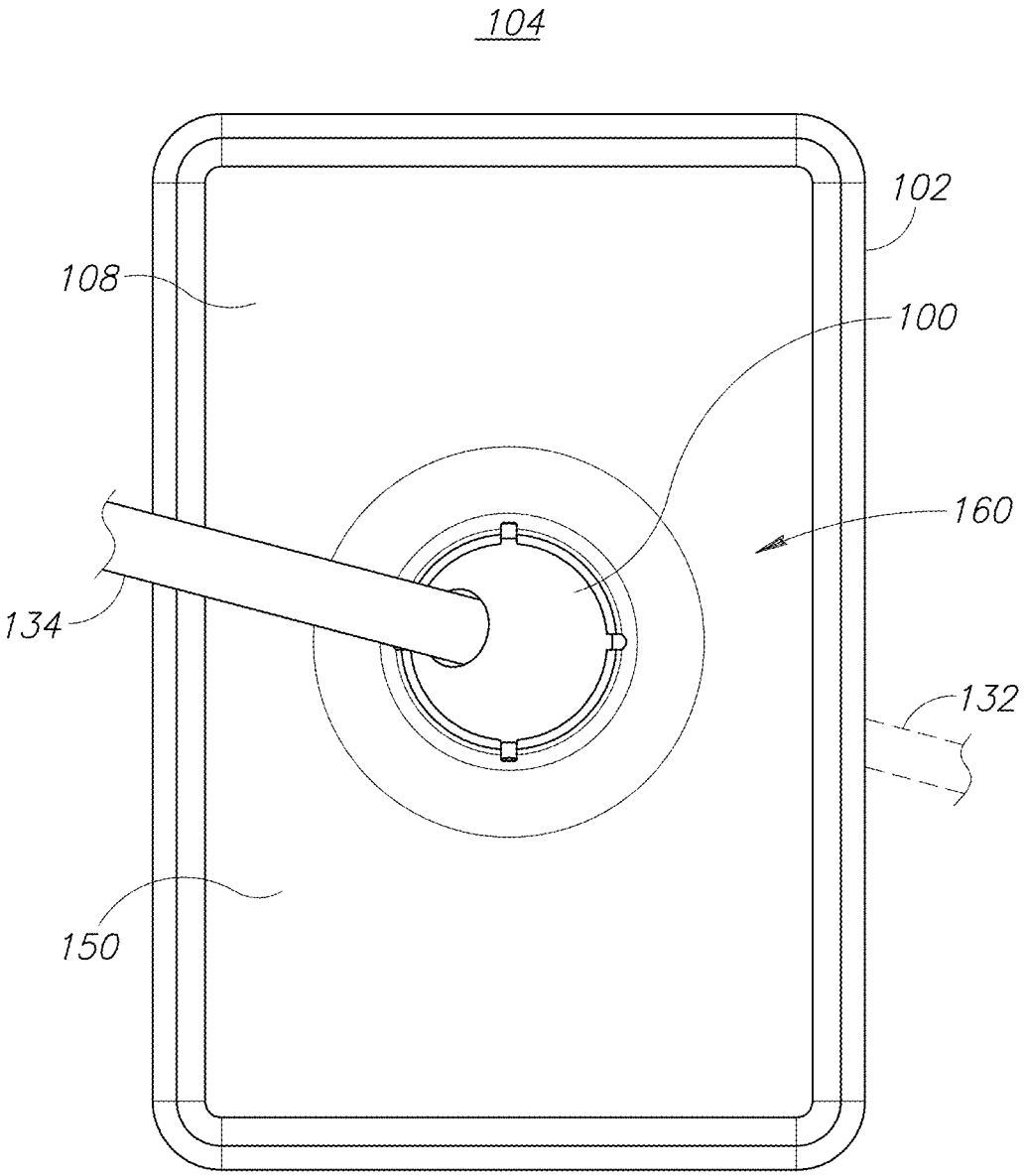
FIG. 2 is a rear view of the first embodiment of the connector assembly.

In the embodiment illustrated in FIG. 1, the first connector 120 is directly connected to a cable 134 that extends outwardly (along the Z-axis) from the backside 108 (see FIG. 2). The first connector 120 is configured to form a communication connection between the cable 134 and the plug 10 when the plug 10 is inserted into the first connector 120. Referring to FIGS. 13-18, 20-22, 25, 27, 30, 31, and 33-41, as will be explained below, in alternate embodiments, the connector assembly 100 may include the second connector 122 (e.g., a plug or an outlet) that is connected to the first connector 120. In such embodiments, the first connector 120 is configured to form a communication connection between the second connector 122 and the plug 10 (see FIGS. 1, 3A-4B, 7-8B, and 41) when the plug 10 is inserted into the first connector 120.

Figure 3A:
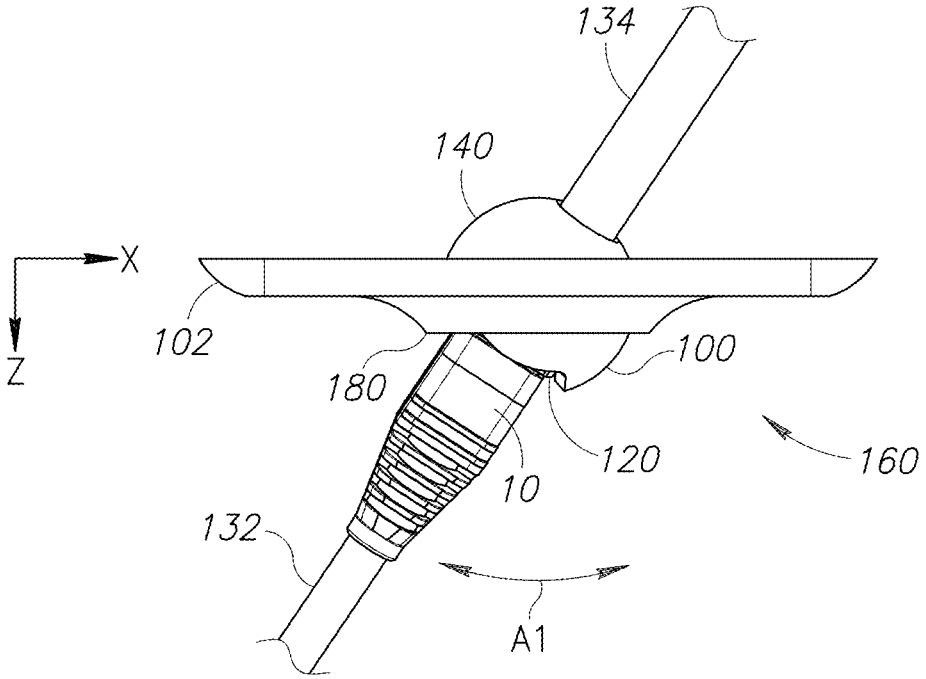
FIG. 3A is a top view of the first embodiment of the connector assembly rotated with respect to the wall plate to position its connector in a leftmost position.
Figure 3B:
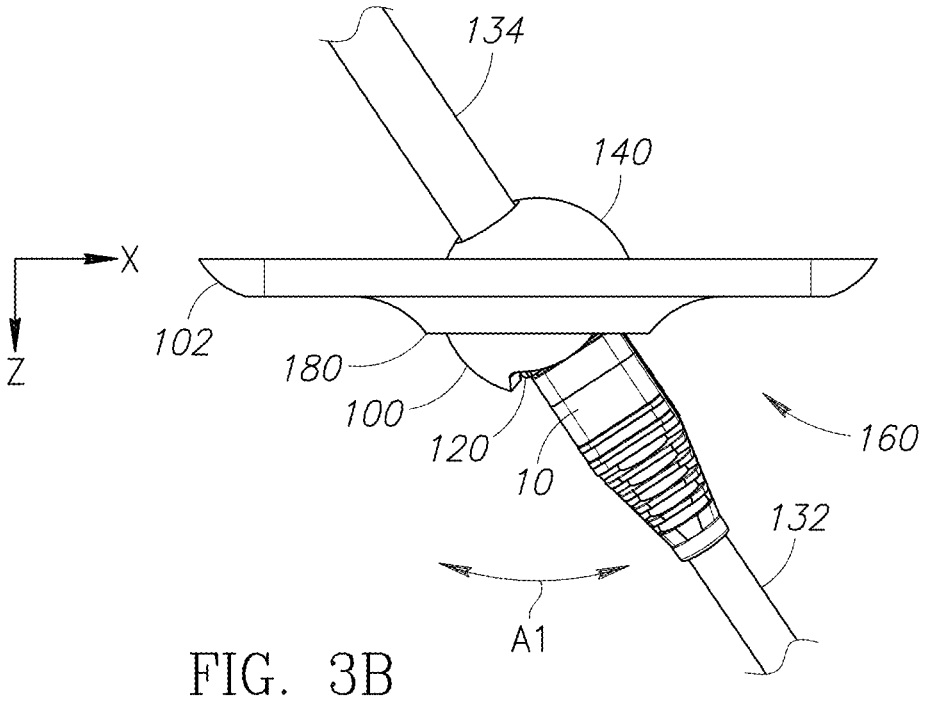
FIG. 3B is a top view of the first embodiment of the connector assembly rotated with respect to the wall plate to position the connector in a rightmost position.
Figure 5:
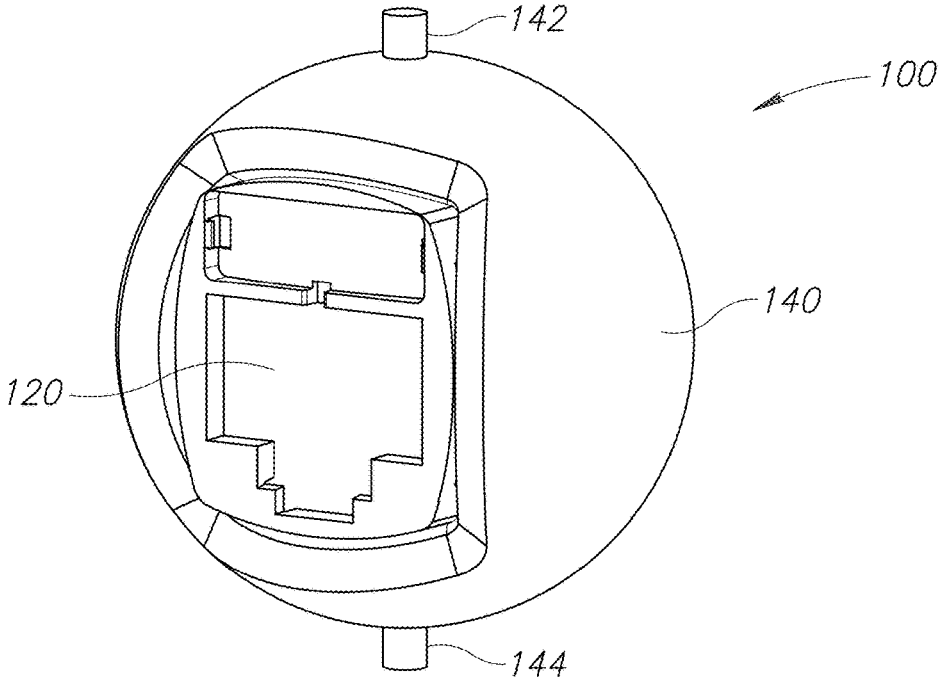
FIG. 5 is a perspective view of the first embodiment of the connector assembly without the wall plate.

Referring to FIG. 5, the connector assembly 100 includes an outer housing 140 having a generally spherical outer shape. Optionally, the outer housing 140 may include a pair of pivot pins 142 and 144 that extend outwardly from the outer housing 140 in opposite directions. The outer housing 140 houses the first connector 120 (and optionally, the second connector 122 illustrated in FIGS. 13-18, 20-22, 25, 27, 30, 31, and 33-41). Referring to FIGS. 3A and 3B, the outer housing 140 is movable and rotates with respect to the wall plate 102. In the embodiment illustrated, the outer housing 140 is rotatable (e.g., left-to-right and vice versa) with respect to the wall plate 102 about the Y-axis (see FIG. 1) in directions identified by a double-headed arrow A1. Thus, if the cable 132 is pulled upon, the outer housing 140 may rotate to at least partially align the first connector 120 with the pull direction and thereby help prevent damage to the plug 10, the cable 132, and/or the first connector 120 caused by side-pull. FIG. 3A illustrates the first connector 120 positioned in a leftmost position and FIG. 3B illustrates the first connector 120 positioned in a rightmost position. However, the outer housing 140 may be rotated to position the first connector 120 in between the positions illustrated in FIGS. 3A and 3B.

Referring to FIGS. 3A and 3B, the cable 134 moves with the first connector 120 when the outer housing 140 is rotated with respect to the wall plate 102. Thus, sufficient slack may be provided in the cable 134 to accommodate this movement.

Figure 6:
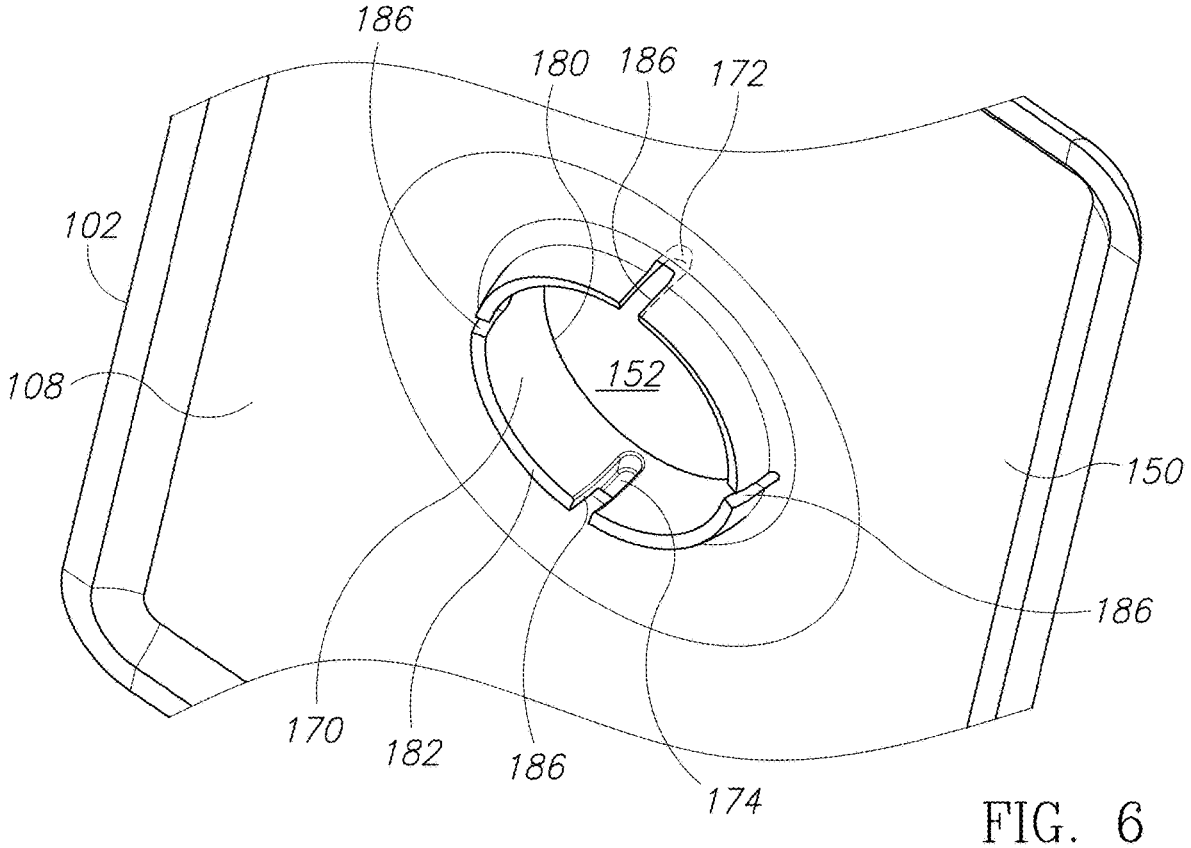
FIG. 6 is a partial rear view of the wall plate of FIG. 1.

Referring to FIG. 6, the wall plate 102 includes a substantially planar body portion 150 with a through-hole 152 formed therein. The through-hole 152 is configured to receive the outer housing 140 (see FIGS. 3A-5) of the connector assembly 100 (see FIGS. 1-5). Thus, the through-hole 152 has a generally round outer shape. Referring to FIGS. 3A and 3B, the through-hole 152 (see FIG. 6) may be characterized as being a socket configured to receive the generally spherical (or ball-shaped) outer housing 140. Thus, together, the outer housing 140 and the wall plate 102 may be characterized as forming a ball joint 160 (See FIGS. 1-4B).

Referring to FIG. 6, the through-hole 152 is defined by a sidewall portion 170 of the wall plate 102. In embodiments in which the outer housing 140 (see FIGS. 3A-5) includes the pivot pins 142 and 144 (see FIG. 5), the wall plate 102 includes a pair of laterally and radially outwardly extending recesses 172 and 174 formed in the sidewall portion 170. The recesses 172 and 174 are configured to receive and retain the pivot pins 142 and 144, respectively. The pivot pins 142 and 144 are rotatable inside the recesses 172 and 174, respectively. Thus, the outer housing 140 may be rotated within the through-hole 152 about the pivot pins 142 and 144. In this manner, referring to FIGS. 3A and 3B, the connector assembly 100 is rotatable about the Y-axis (see FIG. 1) within the wall plate 102.

Figure 4B:
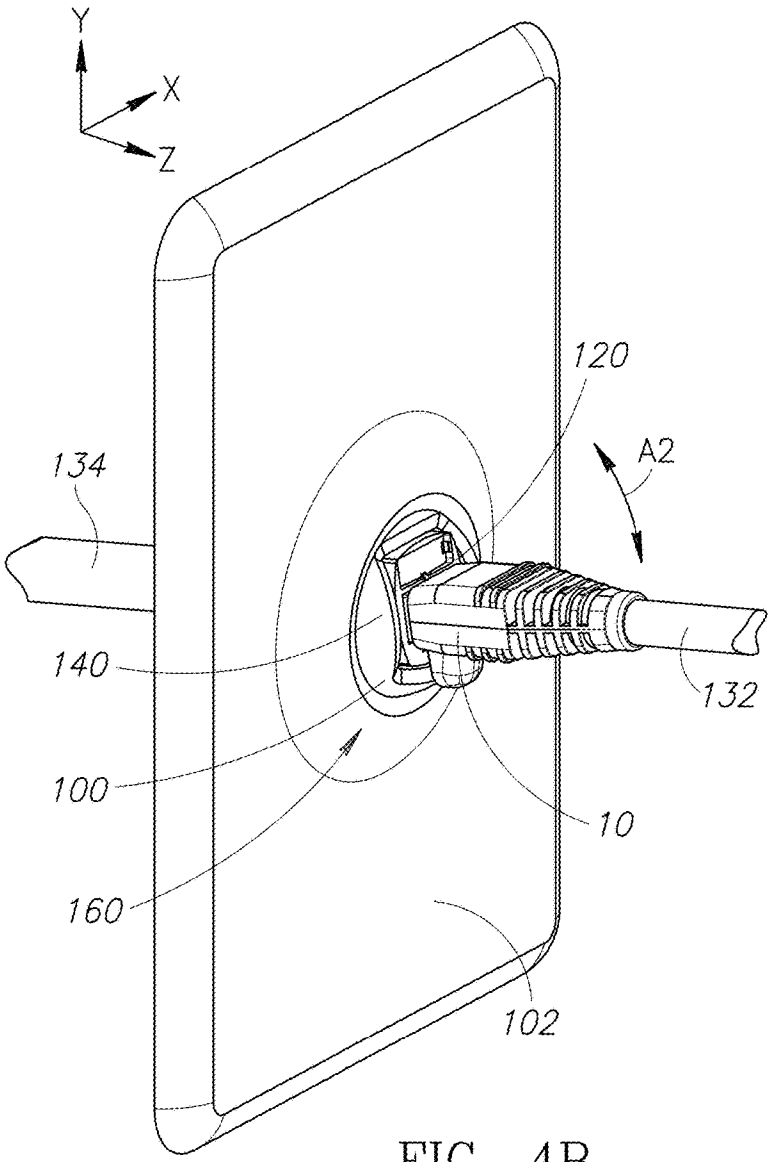
FIG. 4B is a side perspective view of the first embodiment of the connector assembly rotated vertically with respect to the wall plate to position the connector to face downwardly.
Figure 4A:
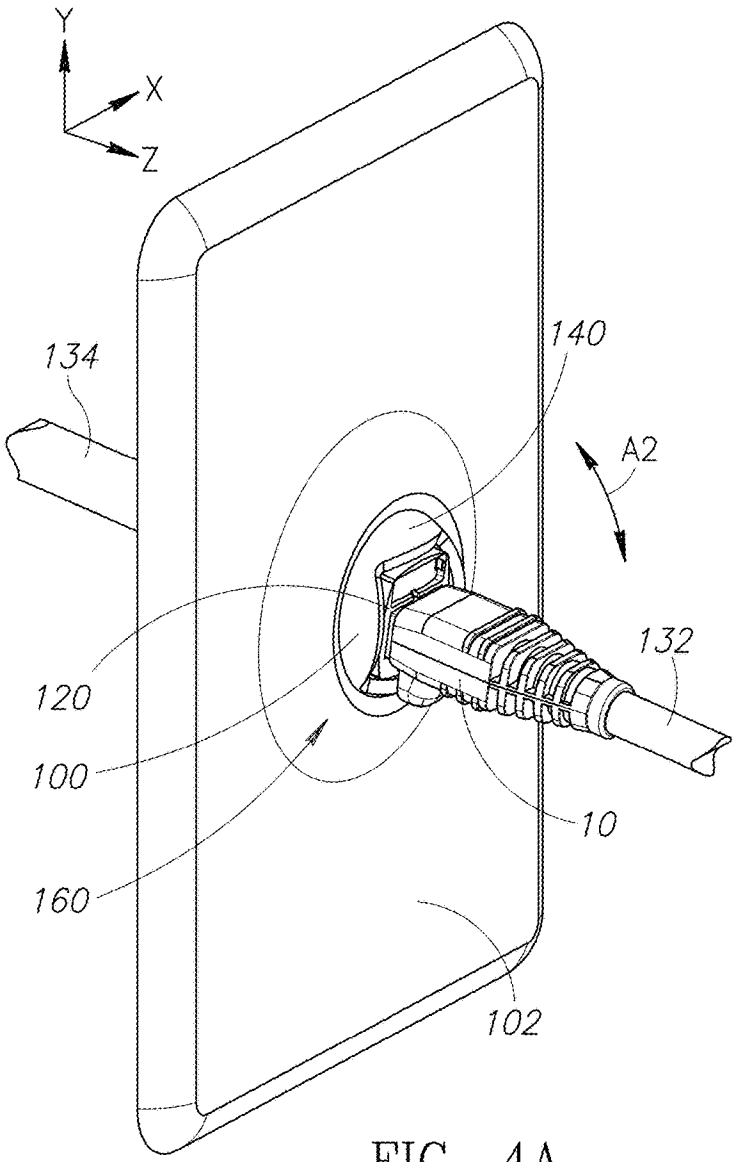
FIG. 4A is a side perspective view of the first embodiment of the connector assembly rotated vertically with respect to the wall plate to position the connector to face upwardly.

Optionally, referring to FIGS. 4A and 4B, the outer housing 140 may be slidable or rotatable within the through-hole 152 (see FIG. 6) about the X-axis to tilt the first connector 120 upwardly and downwardly. In such embodiments, the pivot pins 142 and 144 (see FIG. 5) may slide or rotate inside the recesses 172 and 174 (see FIG. 6), respectively. Thus, the connector assembly 100 may be moveable about the X-axis (e.g., upwardly and downwardly as illustrated by a curved double-headed arrow A2) within the wall plate 102.

In the embodiment illustrated in FIG. 6, portions 180 and 182 of the sidewall portion 170 extends forwardly and rearwardly, respectively, with respect to the body portion 150. Free ends of the portions 180 and 182 may be angled or curved toward the through-hole 152 to help retain the outer housing 140 therein. The rearwardly extending portion 182 may include one or more slots or cutouts 186 that allow the rearwardly extending portion 182 to bend or flex outwardly to allow the outer housing 140 (see FIGS. 3A-5) to be placed inside the through-hole 152. In embodiments that include the recesses 172 and 174, the recesses 172 and 174 may each extend radially outwardly from one of the cutouts 186.

Optionally, the body portion 150 may include one or more through-holes 190 (see FIG. 23) each configured to receive a fastener 192 (see FIG. 23) that fastens the wall plate 102 to the wall 104 (see FIGS. 1, 2, 7, 9A, 9B, 19, 23, and 37) or a wall box (not shown) recessed in the wall 104.

Second Embodiment

Figure 7:
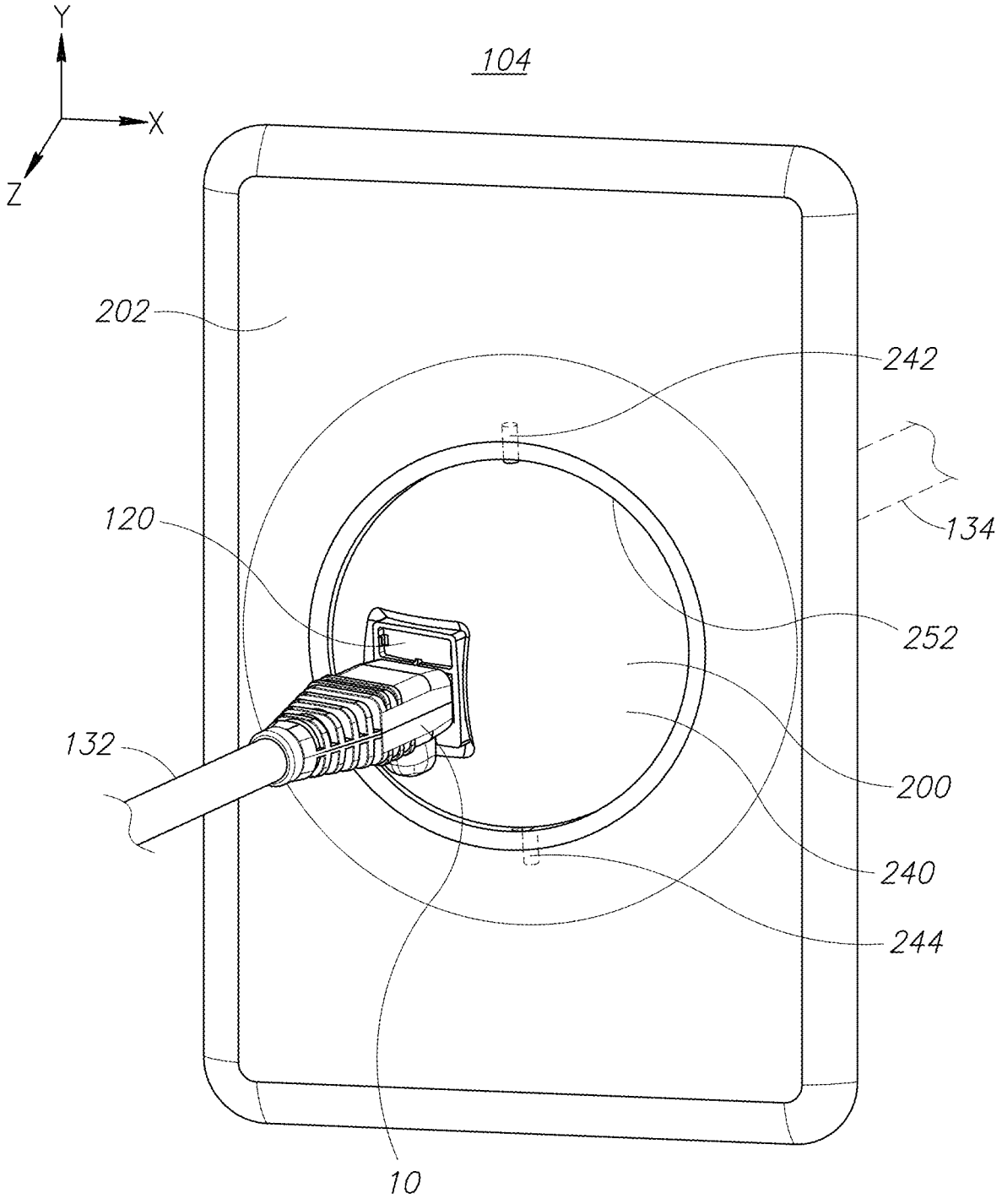
FIG. 7 is a perspective view of a front side of a second embodiment of the connector assembly mounted in a wall plate.
Figure 8A:
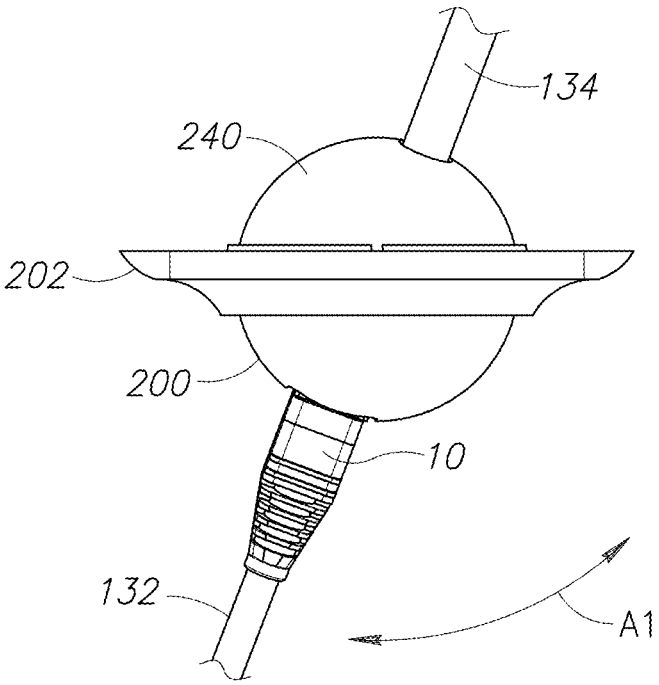
FIG. 8A is a top view of the second embodiment of the connector assembly rotated with respect to the wall plate to position its connector to face toward the left side.
Figure 8B:
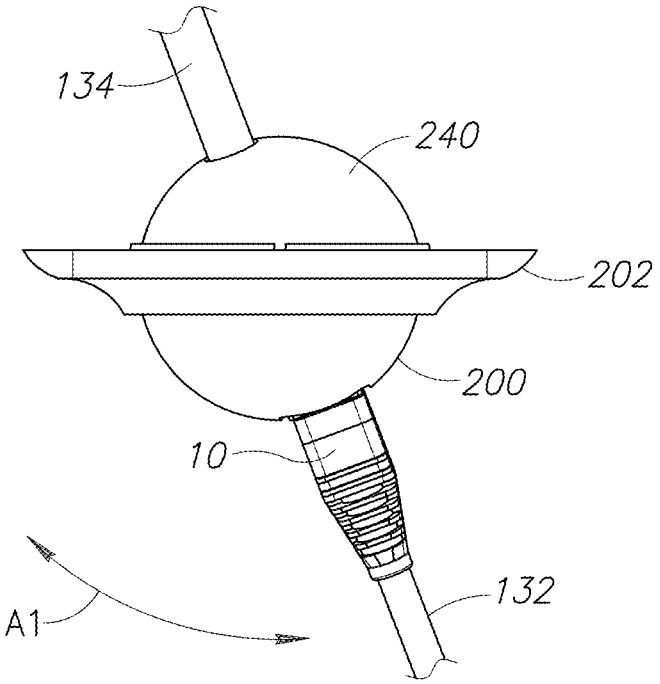
FIG. 8B is a top view of the second embodiment of the connector assembly rotated with respect to the wall plate to position its connector to face toward the right side.
Figure 10:
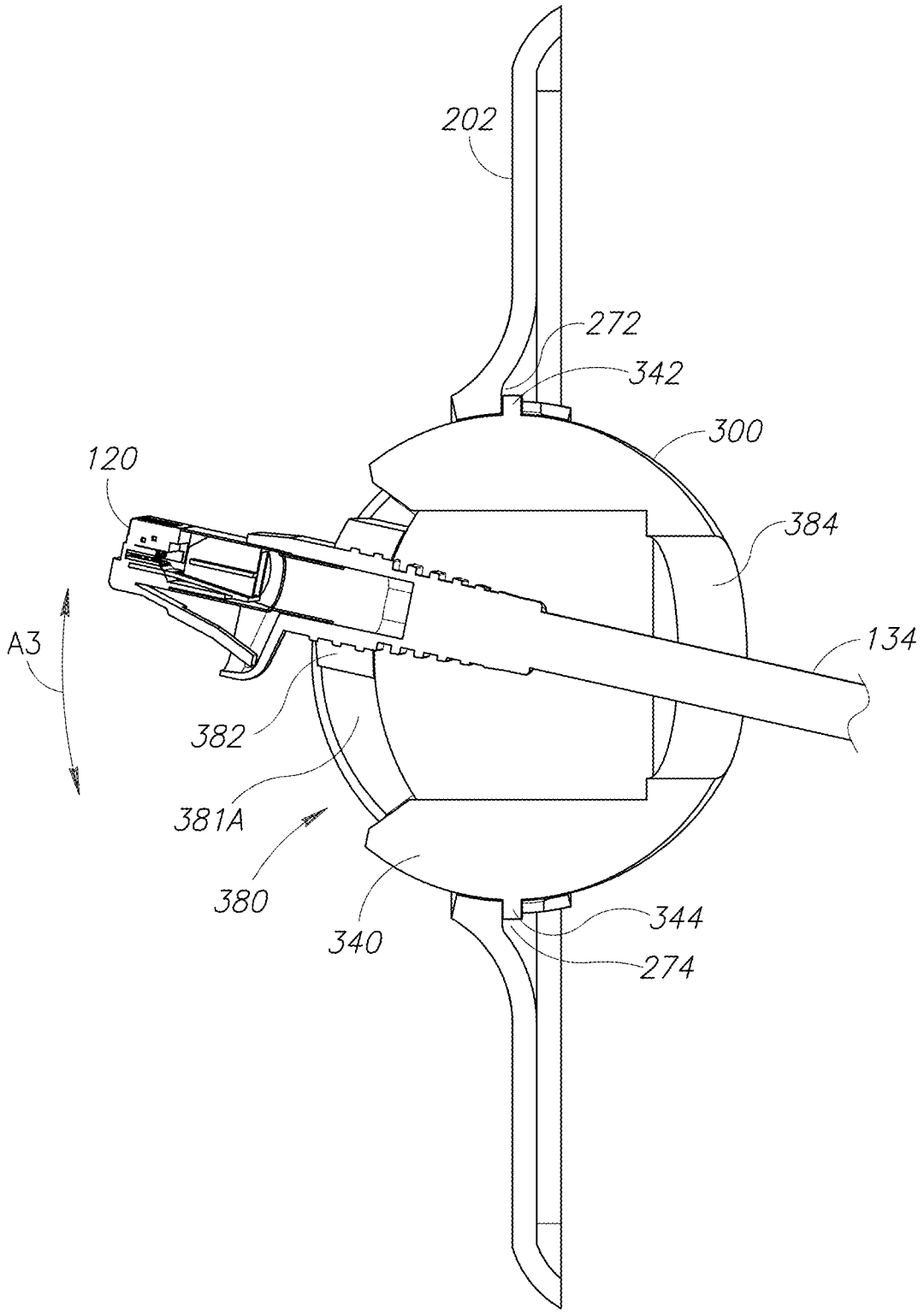
FIG. 10 is a cross-sectional side view of the third embodiment of the connector assembly mounted in the wall plate.

FIG. 7 is a perspective view of a second embodiment of a connector assembly 200 mounted inside a wall plate 202 installed in the wall 104. The connector assembly 200 is substantially identical to the connector assembly 100 (see FIGS. 1-5) except the connector assembly 200 includes an outer housing 240 that is larger (having a larger diameter) than the outer housing 140 (see FIGS. 3A-5). Similarly, the wall plate 202 is substantially identical to the wall plate 102 (see FIGS. 1-4B and 6) except the wall plate 202 includes a through-hole 252 that is larger than the through-hole 152 (see FIG. 6) and configured to receive the larger outer housing 240. The outer housing 240 includes pivot pins 242 and 244 that are substantially identical to the pivot pins 142 and 144 (see FIG. 5). Referring to FIG. 10, the wall plate 202 includes a pair of laterally and radially outwardly extending recesses 272 and 274 that are substantially identical to the recesses 172 and 174 (see FIG. 6) and are configured to receive the pivot pins 242 and 244 (see FIG. 7), respectively. Referring to FIG. 7, because the outer housing 240 is larger, the outer housing 240 may be rotated further (about the pivot pins 242 and 244) with respect to the wall plate 202 than the outer housing 140 (see FIGS. 3A-5) may be rotated (about the pivot pins 142 and 144 illustrated in FIG. 5) with respect to the wall plate 102 (see FIGS. 1-4B and 6). In other words, referring to FIGS. 8A and 8B, the outer housing 240 has a larger range of motion about the Y-axis (see FIG. 7), depicted by the double-headed arrow A1, than the outer housing 140 (see FIGS. 3A and 3B).

Third Embodiment

Figure 9A:
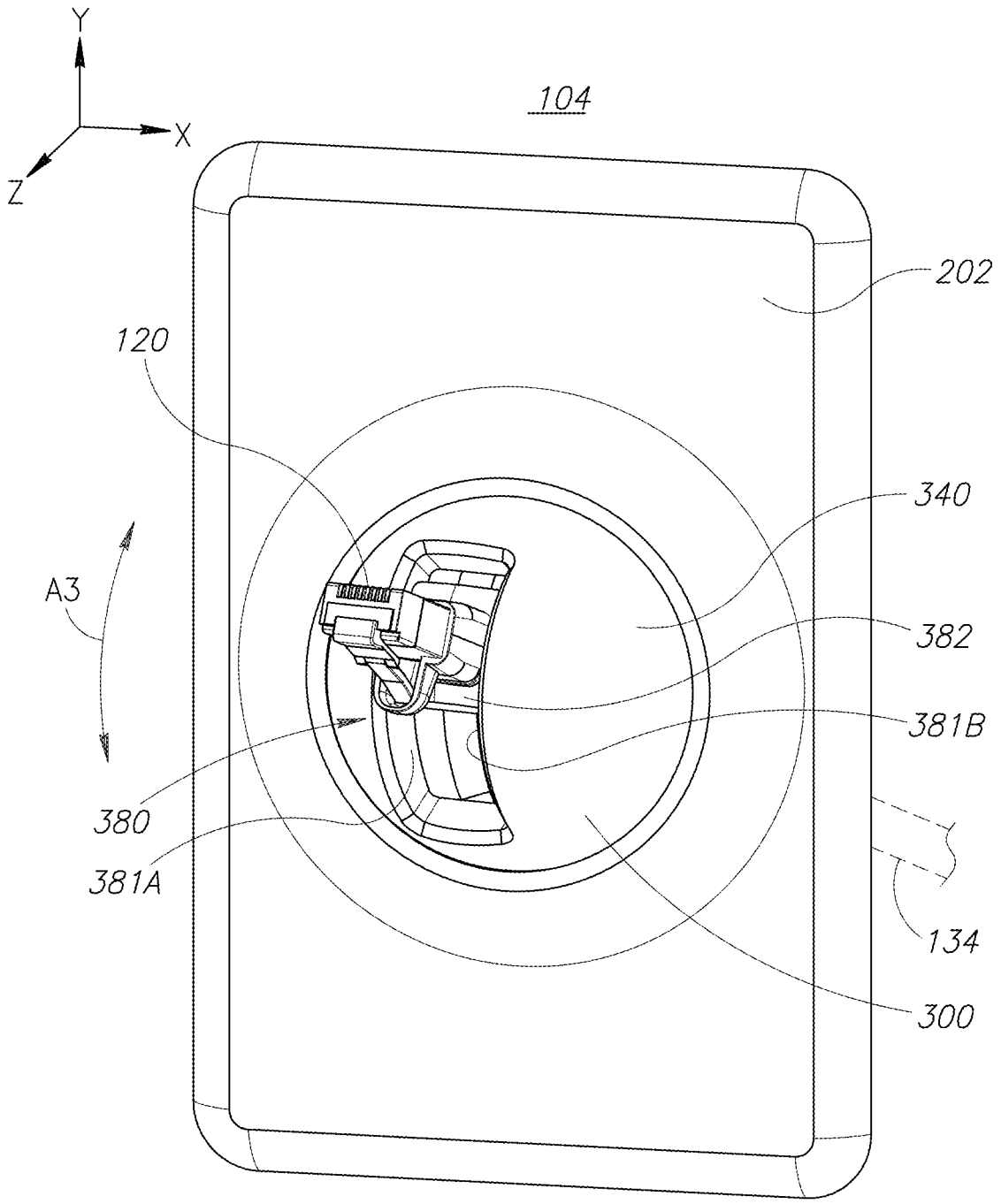
FIG. 9A is a perspective view of a front side of a third embodiment of the connector assembly mounted in a wall plate.
Figure 9B:
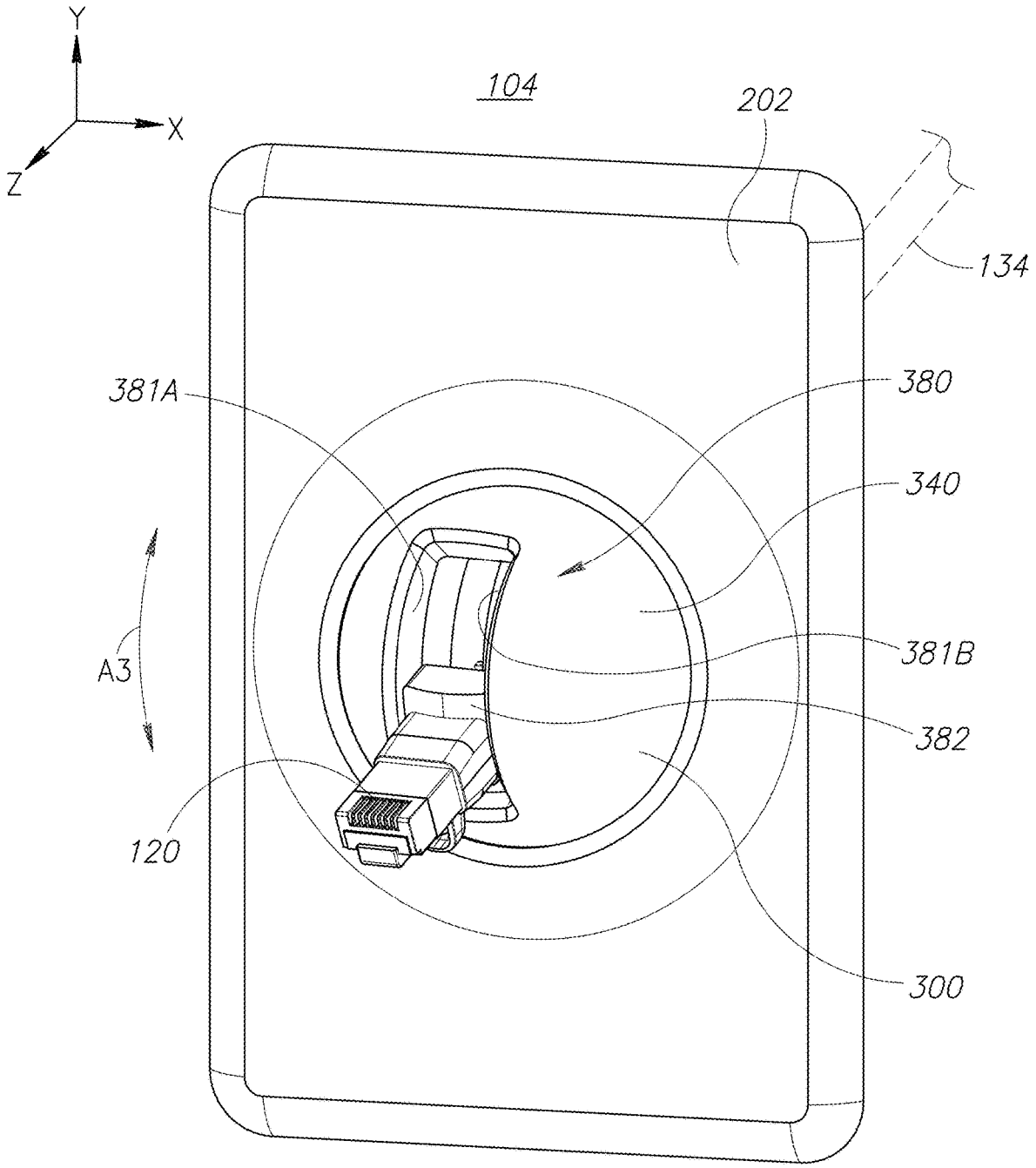
FIG. 9B is a perspective view of the front side of the third embodiment of the connector assembly illustrated with its connector moved downwardly along a track from a position illustrated in FIG. 10.

FIGS. 9A and 9B are perspective views of a third embodiment of a connector assembly 300 mounted inside the wall plate 202 (which may be installed in the wall 104). The connector assembly 300 differs from the connector assembly 200 (see FIGS. 7-8B) in only two respects. First, the first connector 120 of the connector assembly 300 is implemented as a plug (instead of and in place of the outlet) directly connected to the cable 134. The first connector 120 is configured to form a communication connection between the cable 134 and an outlet 20 (see FIG. 41) when the first connector 120 is inserted into the outlet 20. However, in alternate embodiments, the first connector 120 of the connector assembly 300 could be implemented as an outlet directly connected to the cable 134. In such embodiments, the first connector 120 is configured to receive and form an electrical connection with a corresponding plug 10 (e.g., terminating a cable 132) and to form a communication connection between the cable 134 and the plug 10.

Second, the connector assembly 300 includes an outer housing 340 configured to allow the first connector 120 to be moved with respect thereto. As shown in FIGS. 9A and 9B, the first connector 120 is moveable or rotatable about the X-axis (e.g., up and down as illustrated by a curved double-headed arrow A3) as well as about the Y-axis (e.g., side-to-side illustrated by the curved double-headed arrow A1 in FIGS. 3A, 3B, 8A, and 8B). Optionally, the outer housing 340 may itself be slidable or rotatable with respect to the wall plate 202 about the X-axis (e.g., up and down) in a manner similar to that of the outer housing 140 (see FIGS. 3A-5), which is illustrated by the double-headed arrow A2 in FIGS. 4A and 4B.

Referring to FIG. 10, the outer housing 340 includes pivot pins 342 and 344 that are substantially identical to the pivot pins 142 and 144 (see FIG. 5). The recesses 272 and 274 of the wall plate 202 are configured to receive the pivot pins 342 and 344, respectively. The outer housing 340 is rotatable about the pivot pins 342 and 344 with respect to the wall plate 202 about the Y-axis (as illustrated by the curved double-headed arrow A1 in FIGS. 3A, 3B, 8A, and 8B).

Referring to FIG. 9B, the outer housing 340 includes a track 380. The first connector 120 is slidable along the track 380 about the X-axis (as illustrated by the curved double-headed arrow A3). In the embodiment illustrated, the track 380 is implemented as a pair of spaced apart rails 381A and 381B upon which a sliding member 382 is mounted. The sliding member 382 is configured to slide along the rails 381A and 381B. The first connector 120 is attached to the sliding member 382 and is slidable therewith as a unit. Referring to FIG. 10, the cable 134 moves with the first connector 120 when the first connector 120 slides with respect to the outer housing 340 and/or the outer housing 340 is rotated with respect to the wall plate 202. In the embodiment illustrated, the outer housing 340 includes a slot 384 opposite the track 380 configured to allow the cable 134 to move with respect to the outer housing 340 and/or the wall plate 202. Thus, sufficient slack may be provided in the cable 134 to accommodate this movement.

Fourth Embodiment

Figure 11:
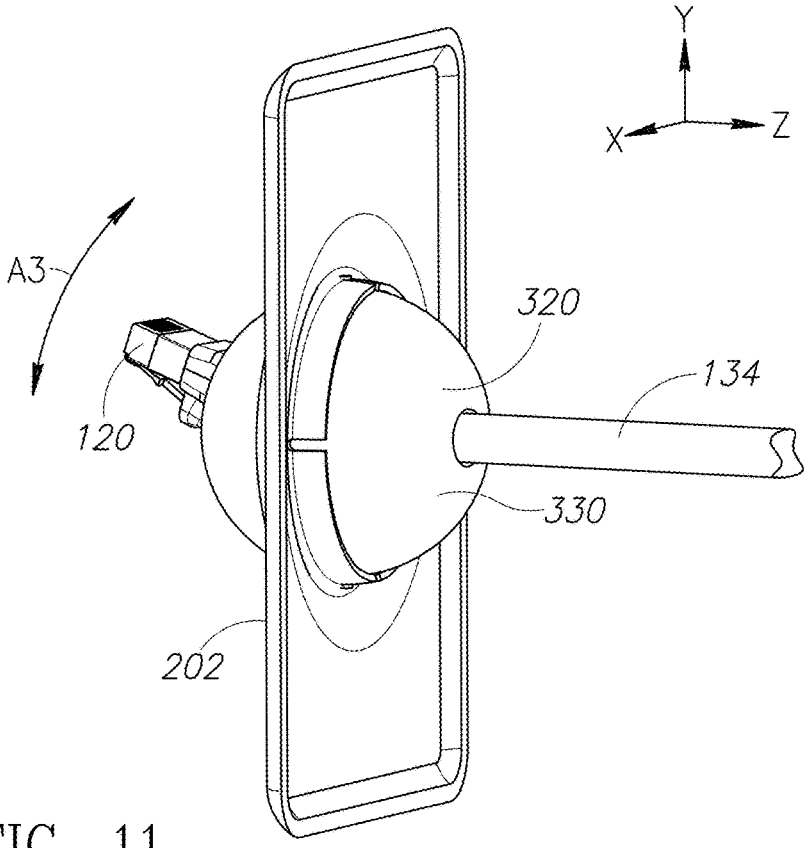
FIG. 11 is a perspective view of a fourth embodiment of a connector assembly.

FIG. 11 is a perspective view of a fourth embodiment of a connector assembly 320 mounted inside the wall plate 202 (which may be installed in the wall 104 illustrated in FIGS. 1, 2, 7, 9A, 9B, 19, 23, and 37). The connector assembly 320 differs from the connector assembly 200 (see FIGS. 7-8B) in only two respects. First, the first connector 120 of the connector assembly 320 is implemented as a plug (instead of and in place of the outlet). The first connector 120 is configured to form a communication connection between the outlet 20 (see FIG. 41) and the cable 134 when the first connector 120 is inserted into the outlet 20. However, in alternate embodiments, the first connector 120 of the connector assembly 320 could be implemented as an outlet. In such embodiments, the first connector 120 is configured to receive and form an electrical connection with a corresponding plug 10 (e.g., terminating a cable 132) and to form a communication connection between the cable 134 and the plug 10.

Second, the connector assembly 320 includes an outer housing 330 configured to allow the first connector 120 to be moved with respect thereto. The first connector 120 is mounted on a track (not shown) substantially identical to the track 380 (see FIGS. 9A-10). Thus, the first connector 120 is slidable along the track (not shown) about the X-axis (as illustrated by the curved double-headed arrow A3).

The outer housing 330 includes pivot pins (not shown) that are substantially identical to the pivot pins 242 and 244 (see FIG. 7). The recesses 272 and 274 (see FIG. 10) of the wall plate 202 are configured to receive the pivot pins (not shown) in the same manner the pivot pins 242 and 244 (see FIG. 5) are received thereby. Thus, the outer housing 330 is rotatable about the pivot pins (not shown) with respect to the wall plate 202 about the Y-axis (as illustrated by the curved double-headed arrow A1 in FIGS. 3A, 3B, 8A, and 8B). In other words, the first connector 120 is moveable or rotatable about the X-axis (e.g., as illustrated by the curved double-headed arrow A3) as well as about the Y-axis (e.g., as illustrated by the curved double-headed arrow A1 in FIGS. 3A, 3B, 8A, and 8B) and, optionally, about the X-axis (e.g., as illustrated by the double-headed arrow A2 in FIGS. 4A and 4B).

Figure 12:
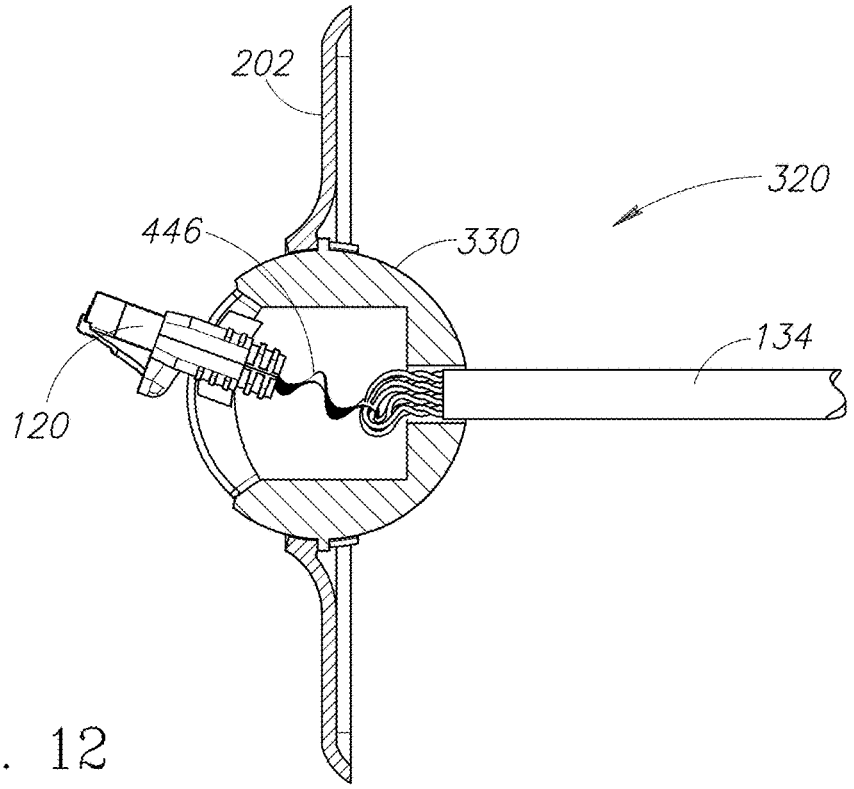
FIG. 12 is a cross-sectional side view of the fourth embodiment of the connector assembly.
Figure 13:
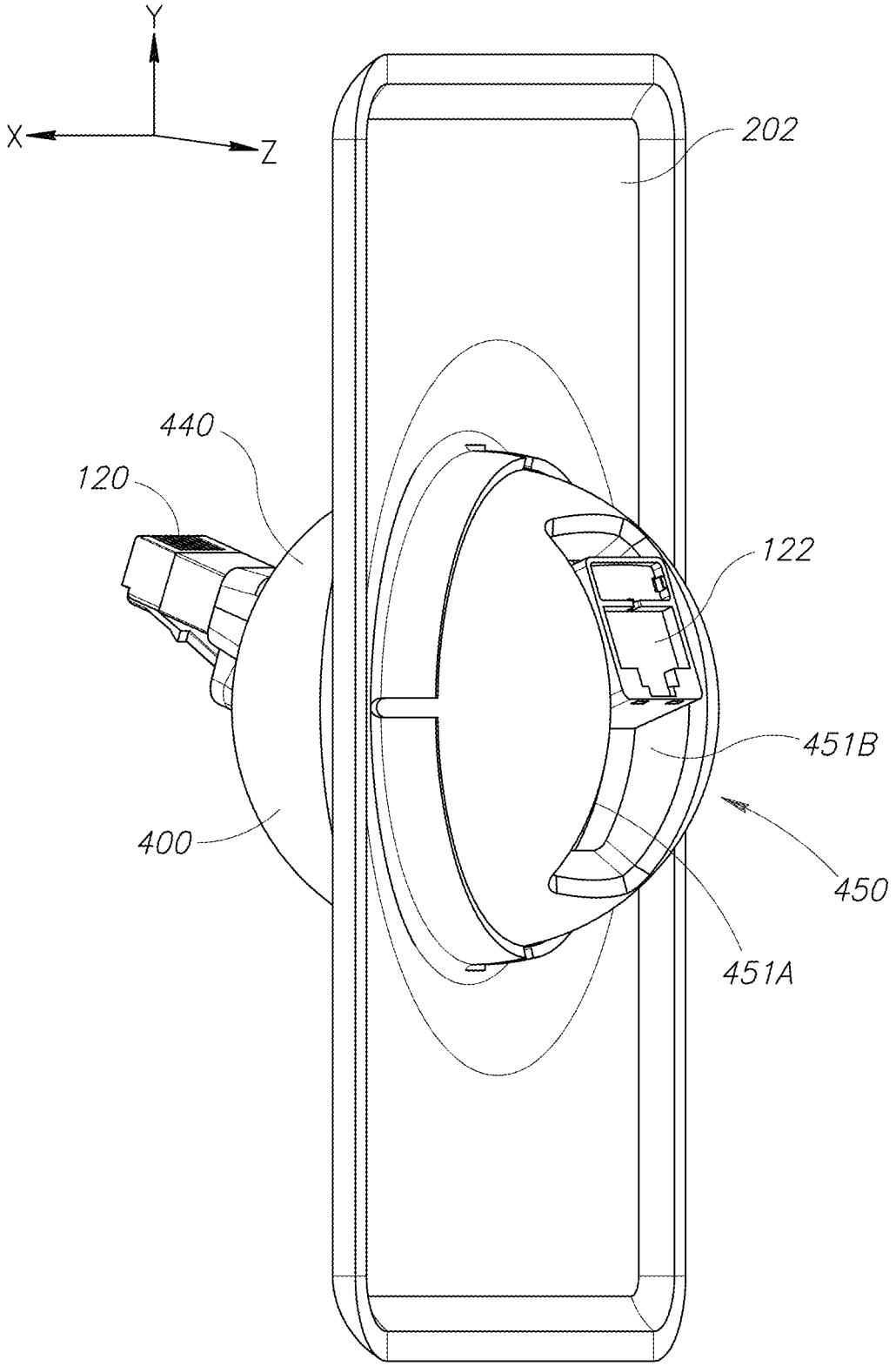
FIG. 13 is a perspective view of a back side of a fifth embodiment of the connector assembly mounted in a wall plate.

Referring to FIG. 12, inside the outer housing 330, the first connector 120 is connected electrically to the cable 134 by a flexible substrate 446 (e.g., a flexible circuit board) configured to bend and flex as necessary whenever the first connector 120 moves. In the embodiment illustrated, the flexible substrate 446 may be twisted (e.g., in a helical shape) or coiled to accommodate changes in a distance and/or orientation between the first connector 120 and the cable 134. The flexible substrate 446 is described in greater detail below.

Fifth Embodiment

FIG. 13 is a perspective view of a fifth embodiment of a connector assembly 400 mounted inside the wall plate 202 (which may be installed in the wall 104 as illustrated in FIGS. 7, 9A, 9B, and 19). The connector assembly 400 differs from the connector assembly 300 (see FIGS. 9A-10) in only two respects. First, the first connector 120 is connected to the second connector 122 (e.g., an outlet), instead of to the cable 134 (see FIGS. 1-4B and 7-12). Thus, the connector assembly 400 includes two communication connections, namely the first and second connectors 120 and 122. The first connector 120 faces forwardly and the second connector 122 faces rearwardly.

Figure 21:
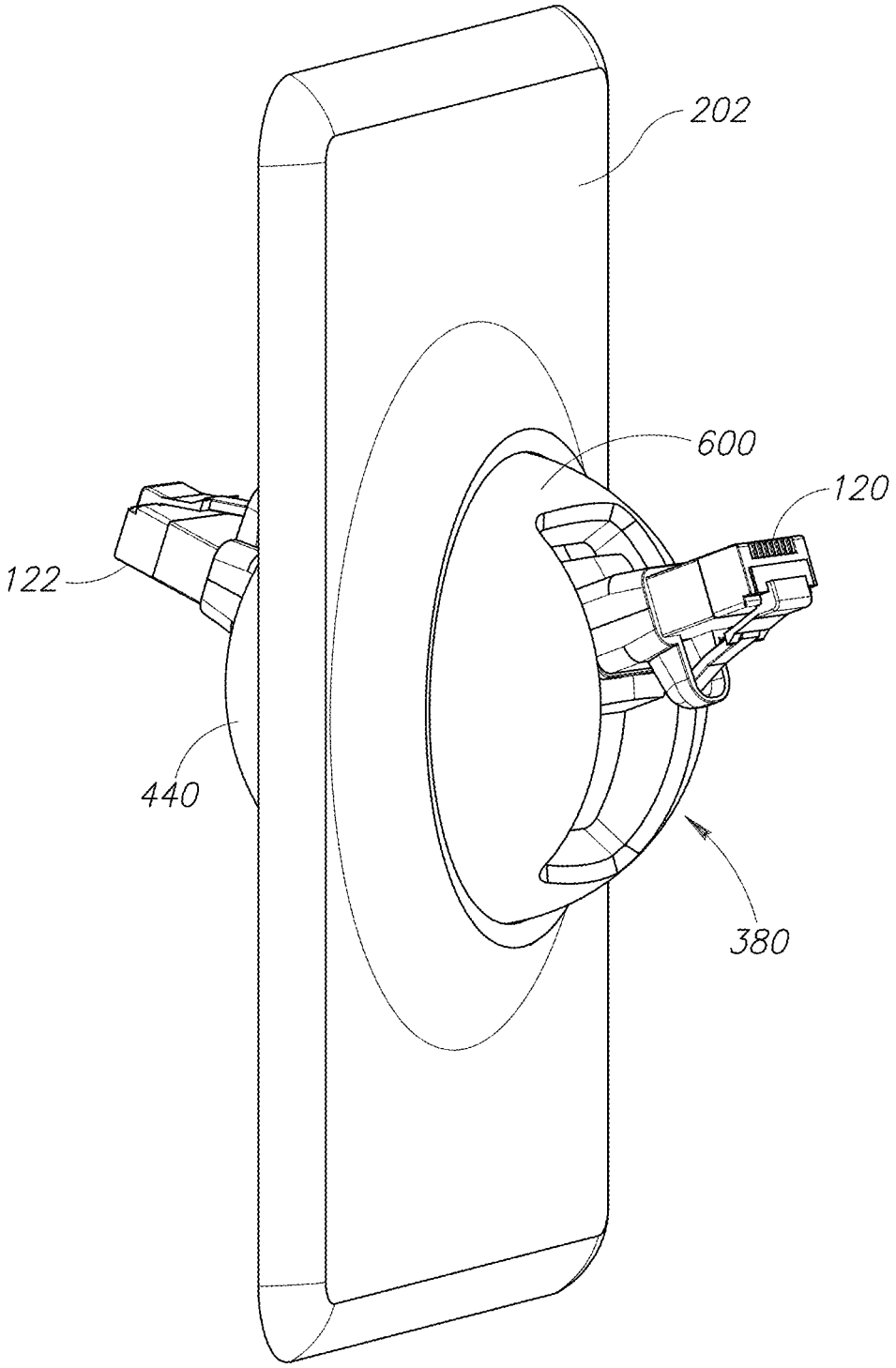
FIG. 21 is a perspective view of a front side of a seventh embodiment of the connector assembly mounted in a wall plate.
Figure 22:
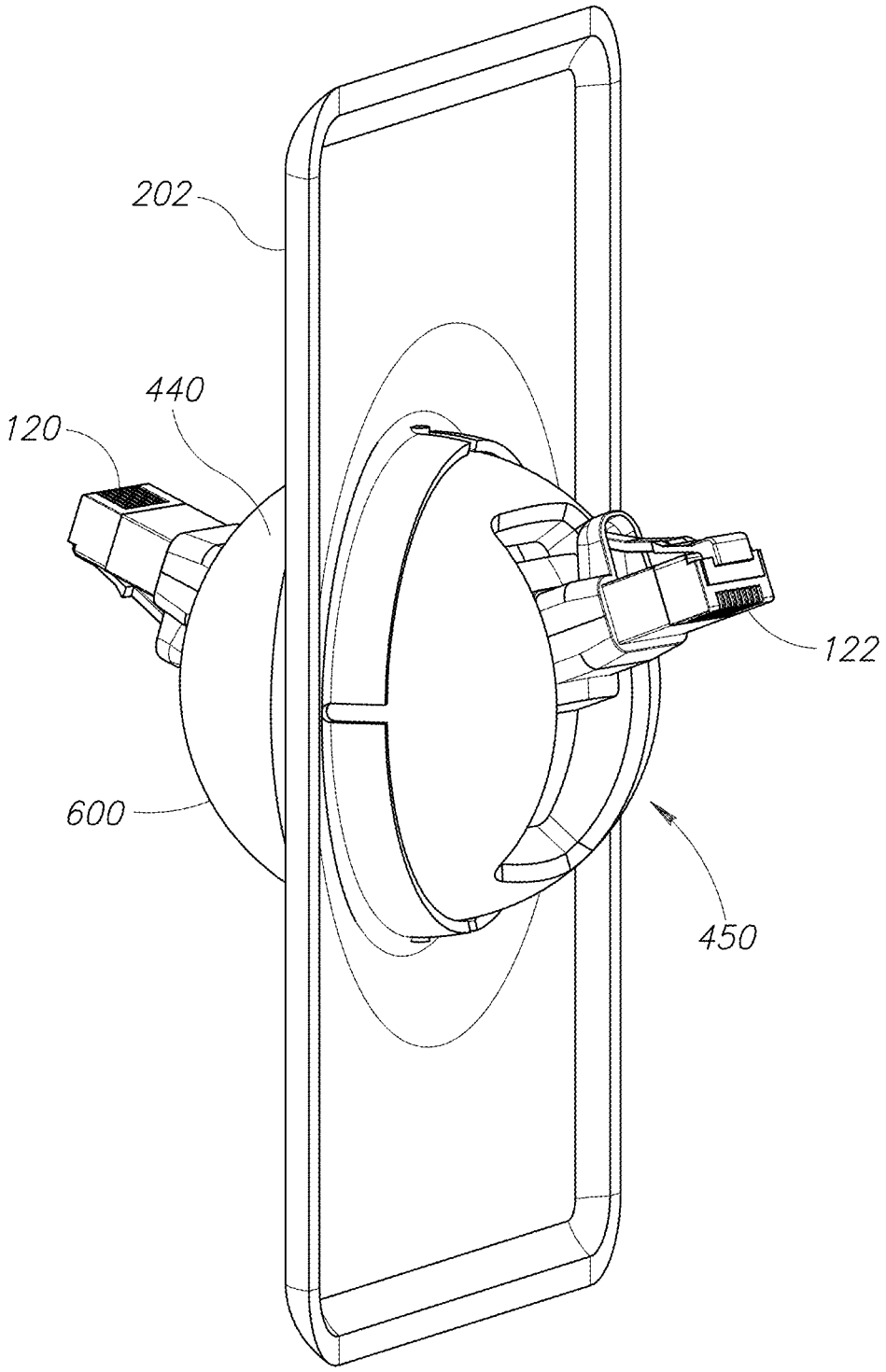
FIG. 22 is a perspective view of a rear side of the seventh embodiment of the connector assembly mounted in the wall plate.

In the embodiment illustrated, the first connector 120 has been implemented as a forwardly facing plug and the second connector 122 has been implemented as a rearwardly facing outlet. In alternative embodiments, referring to FIGS. 19 and 20, the first connector 120 may be implemented as a forwardly facing outlet. Referring to FIGS. 21 and 22, by way of yet another non-limiting example, the second connector 122 may be implemented as a rearwardly facing plug.

Figure 14:
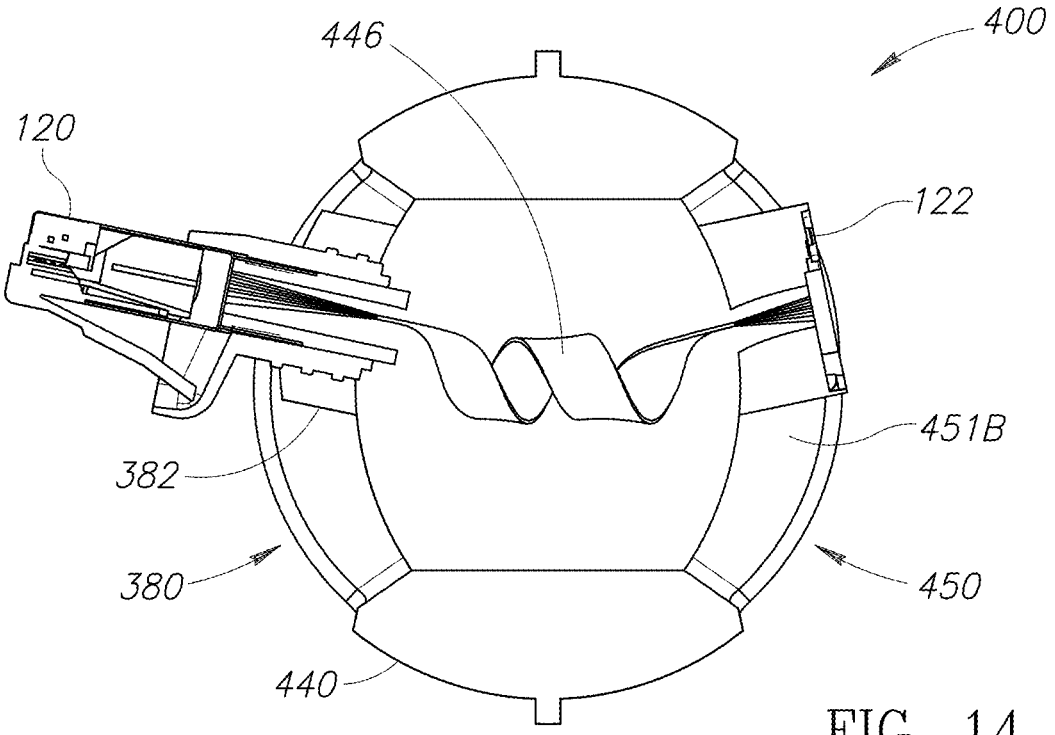
FIG. 14 is a cross-sectional side view of the fifth embodiment of the connector assembly.
Figure 15:
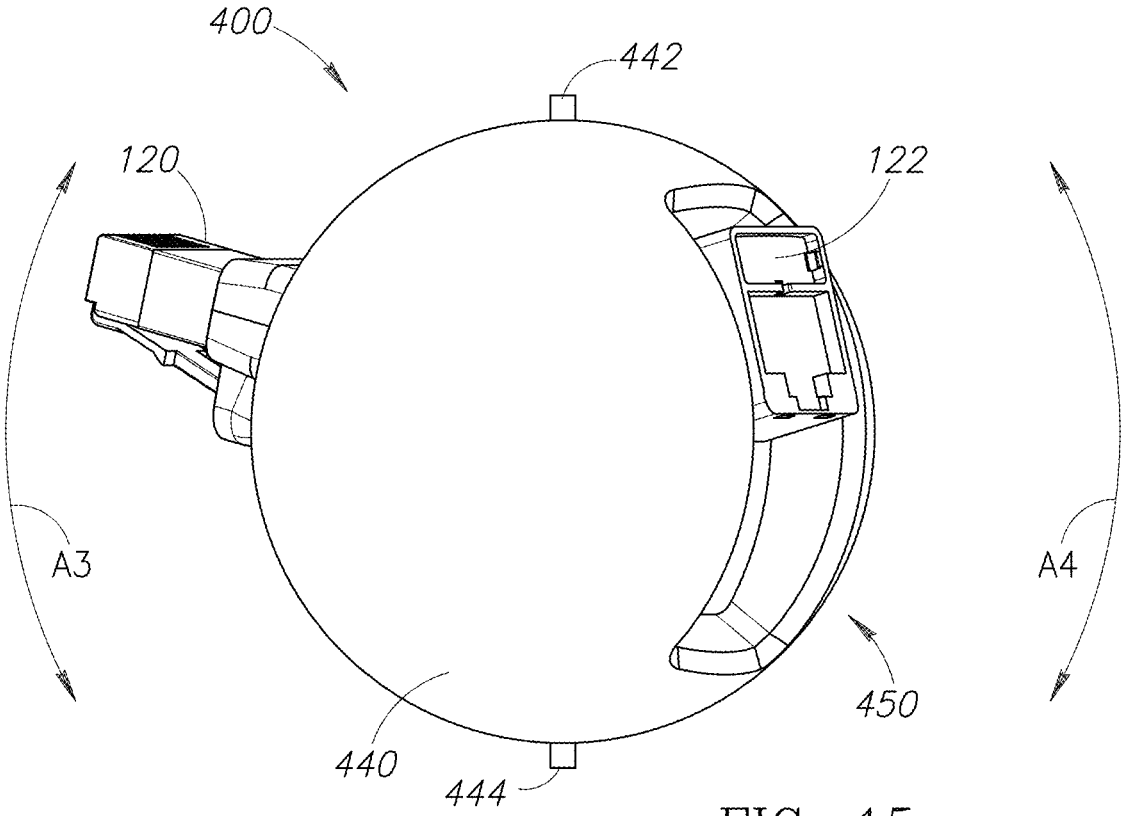
FIG. 15 is a perspective view of the back side of the fifth embodiment of the connector assembly with its first connector in a first position and its second connector in a second position.
Figure 16:
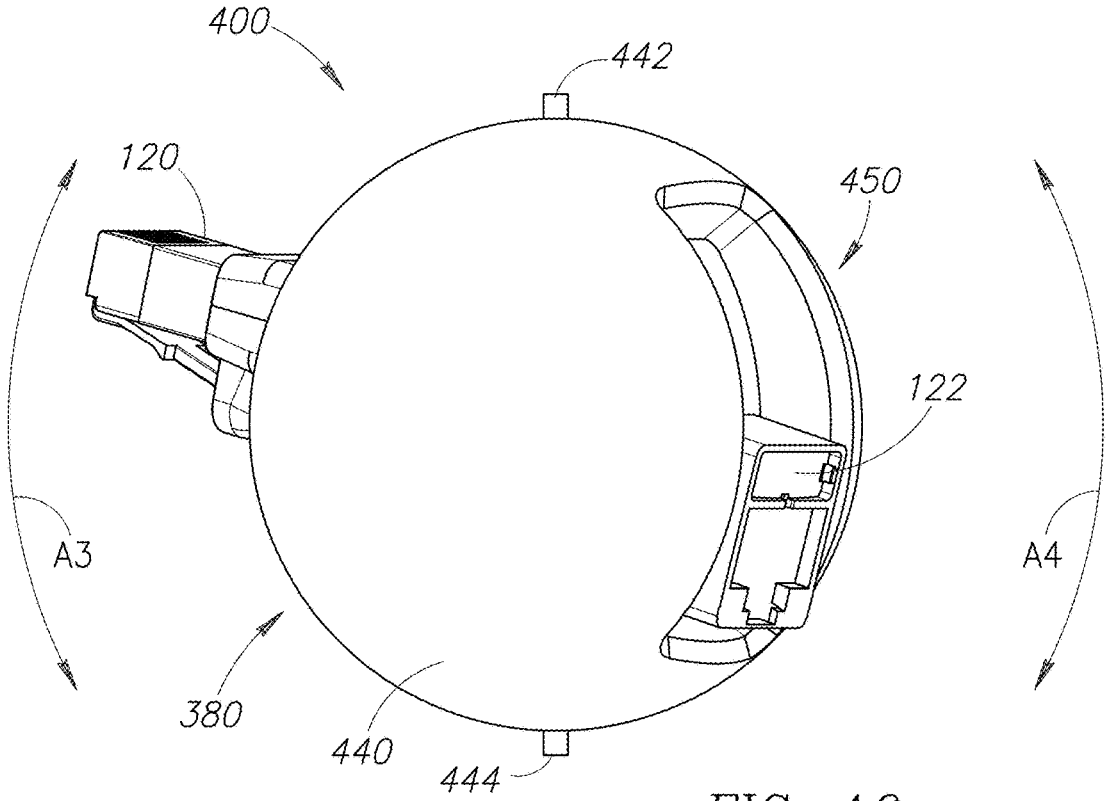
FIG. 16 is a perspective view of the back side of the fifth embodiment of the connector assembly with its first connector in the first position and its second connector in a third position.
Figure 17:
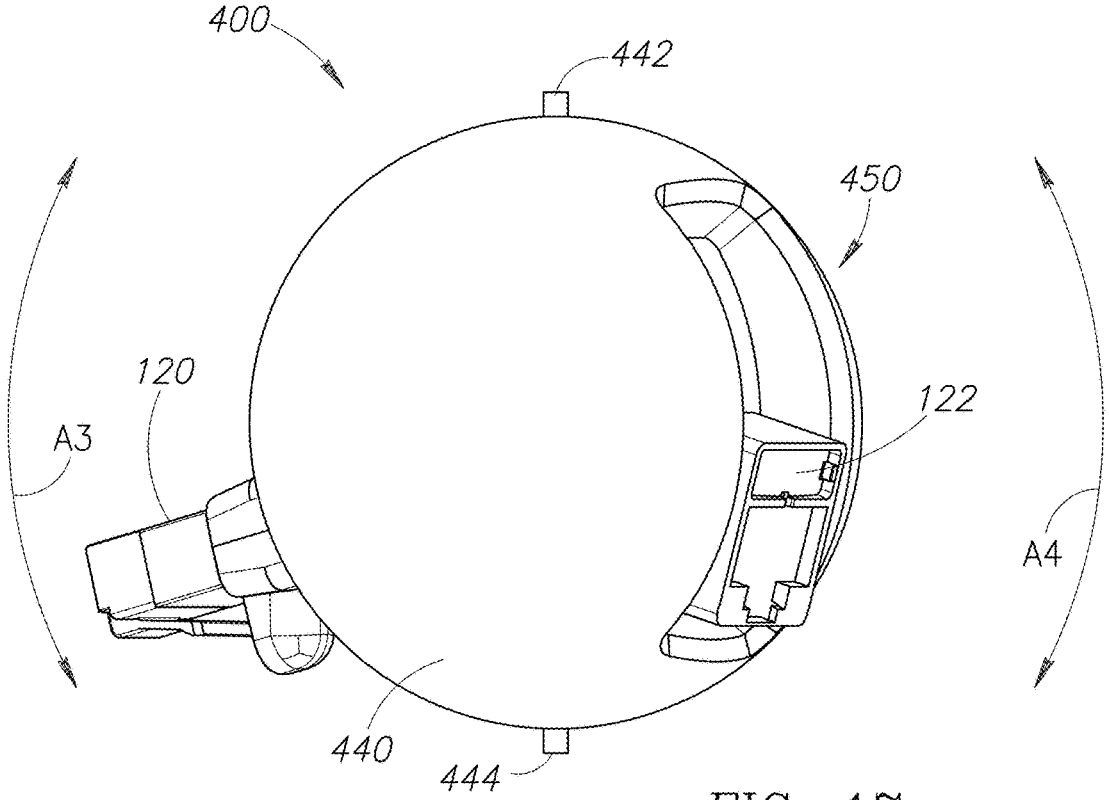
FIG. 17 is a perspective view of the back side of the fifth embodiment of the connector assembly with its first connector in a fourth position and its second connector in the third position.
Figure 18:
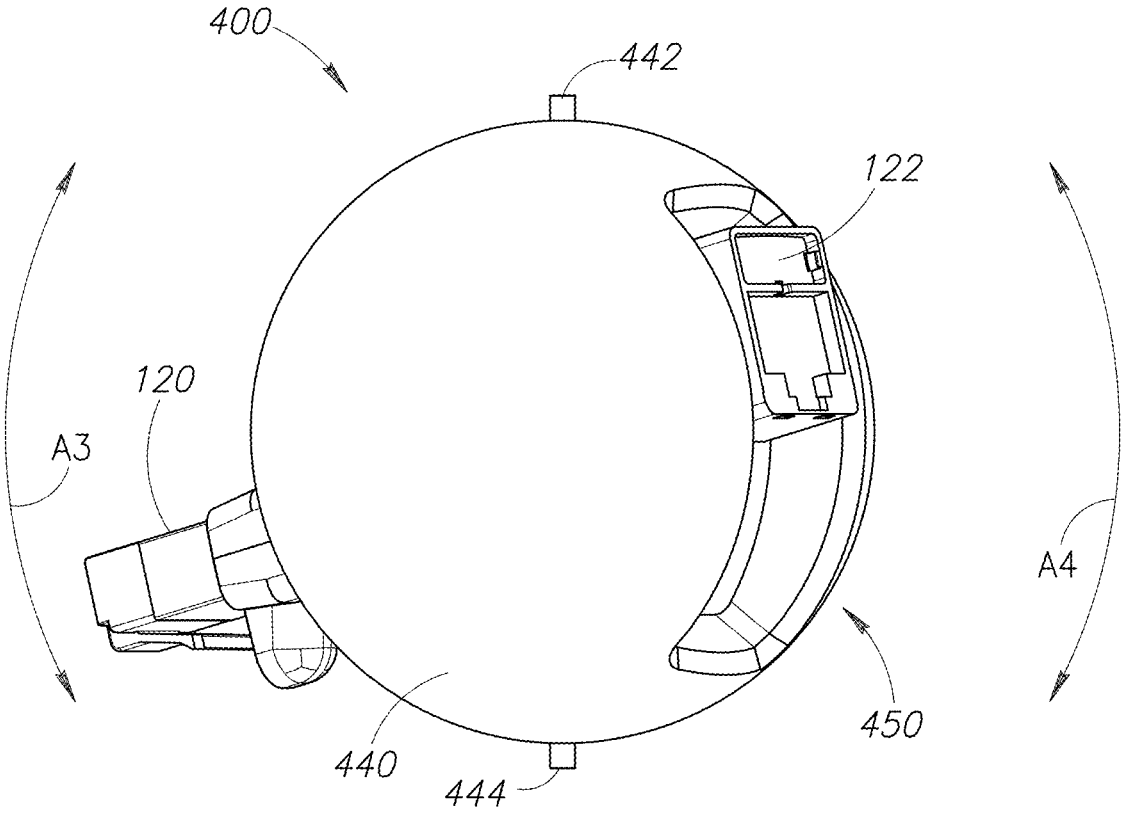
FIG. 18 is a perspective view of the back side of the fifth embodiment of the connector assembly with its first connector in the fourth position and its second connector in the second position.

Referring to FIG. 13, the second manner in which the connector assembly 400 differs from the connector assembly 300 (see FIGS. 9A-10) is that the connector assembly 400 includes an outer housing 440 instead and in place of the outer housing 340 (see FIGS. 9A-10). Referring to FIG. 14, the outer housing 440 has a second track 450 in addition to the first track 380. The second track 450 is substantially identical to the first track 380. Like in the connector assembly 300 (see FIGS. 9A-10), the first connector 120 is slidable along the first track 380 of the connector assembly 400. The second connector 122 is similarly and independently slidable along the second track 450. In the embodiment illustrated in FIG. 13, the second track 450 is implemented as a pair of spaced apart rails 451A and 451B upon which the second connector 122 is mounted. Optionally, referring to FIG. 14, the second connector 122 may be mounted on a sliding member (not shown) substantially identical to the sliding member 382. Referring to FIG. 13, the second connector 122 and the optional sliding member (not shown), when present, slide along the rails 451A and 451B.

As shown in FIGS. 15-18, the first connector 120 is rotatable (as illustrated by the double-headed arrow A3) about the X-axis (see FIG. 13) and the second connector 122 is rotatable (as illustrated by a double-headed arrow A4) about the X-axis with respect one another. The outer housing 440 includes pivot pins 442 and 444 that are substantially identical to the pivot pins 142 and 144 (see FIG. 5). Referring to FIG. 10, the recesses 272 and 274 of the wall plate 202 are configured to receive the pivot pins 442 and 444 (see FIG. 15-18), respectively. Referring to FIGS. 15-18, the outer housing 440 is rotatable about the pivot pins 442 and 444 with respect to the wall plate 202 (see FIGS. 7-13, 19, 21, and 22) about the Y-axis (e.g., side-to-side as illustrated by the double-headed arrow A1 in FIGS. 3, 4, 8A, and 4B).

Referring to FIG. 14, inside the outer housing 440, the first connector 120 may be connected electrically to the second connector 122 by the flexible substrate 446 configured to bend and flex as necessary whenever one or both of the first and second connectors 120 and 122 move. In the embodiment illustrated, the flexible substrate 446 may be twisted (e.g., in a helical shape) or coiled to accommodate changes in a distance and/or orientation between the first and second connectors 120 and 122. The flexible substrate 446 is described in greater detail below.

Sixth Embodiment

Figure 19:
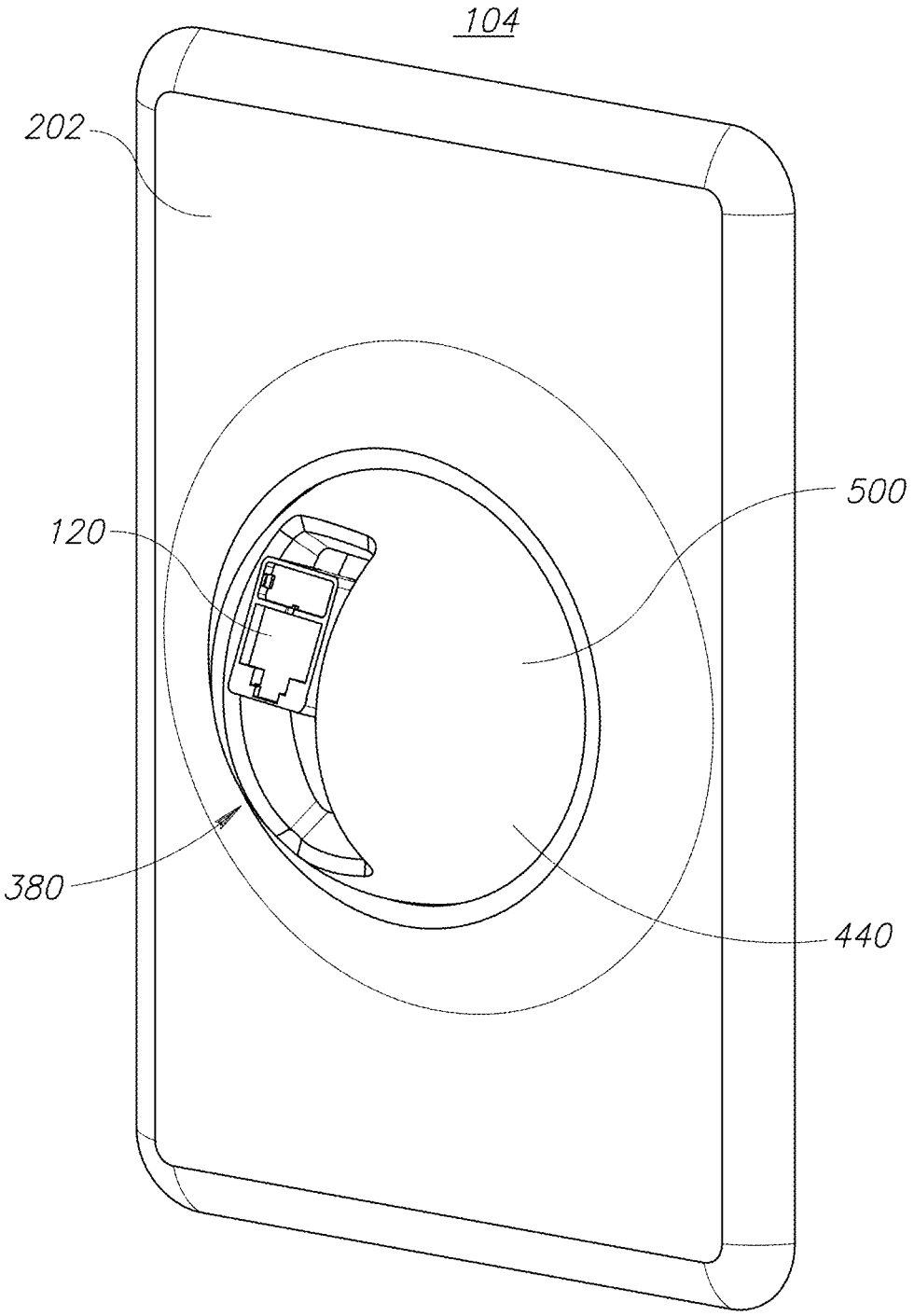
FIG. 19 is a perspective view of a front side of a sixth embodiment of the connector assembly mounted in a wall plate.
Figure 20:
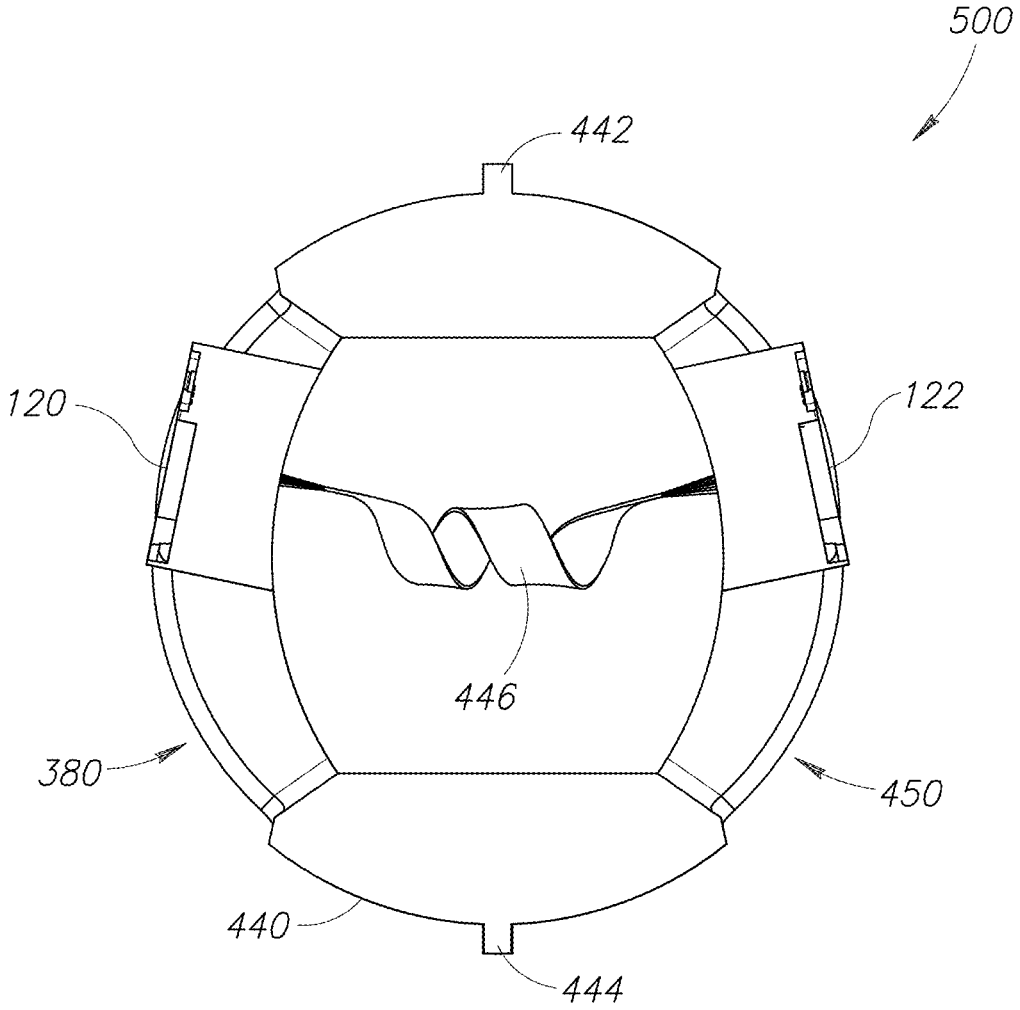
FIG. 20 is a cross-sectional side view of the sixth embodiment of the connector assembly.

FIG. 19 is a perspective view of a sixth embodiment of a connector assembly 500 mounted inside the wall plate 202 (which may be installed in the wall 104). The connector assembly 500 is substantially similar to the connector assembly 400 (see FIGS. 13-18) and includes the outer housing 440. However, referring to FIG. 18, in the connector assembly 400, the first and second connectors 120 and 122 are illustrated as being implemented as a plug and an outlet, respectively. On the other hand, referring to FIG. 20, the first and second connectors 120 and 122 of the connector assembly 500 have each been implemented as an outlet. The first and second connectors 120 and 122 are connected together electrically by the flexible substrate 446 (described below).

Seventh Embodiment

FIGS. 21 and 22 are perspective views of an seventh embodiment of a connector assembly 600 mounted inside the wall plate 202 (which may be installed in the wall 104 as illustrated in FIGS. 7, 9A, 9B, and 19). The connector assembly 600 is substantially similar to the connector assembly 400 (see FIGS. 13-18) and includes the outer housing 440. However, in the connector assembly 600, the first and second connectors 120 and 122 have each been illustrated as a plug. The first and second connectors 120 and 122 are connected together electrically by the flexible substrate 446 (illustrated in FIGS. 12, 14, 20, 27, and 42 and described below).

Eighth Embodiment

Figure 23:
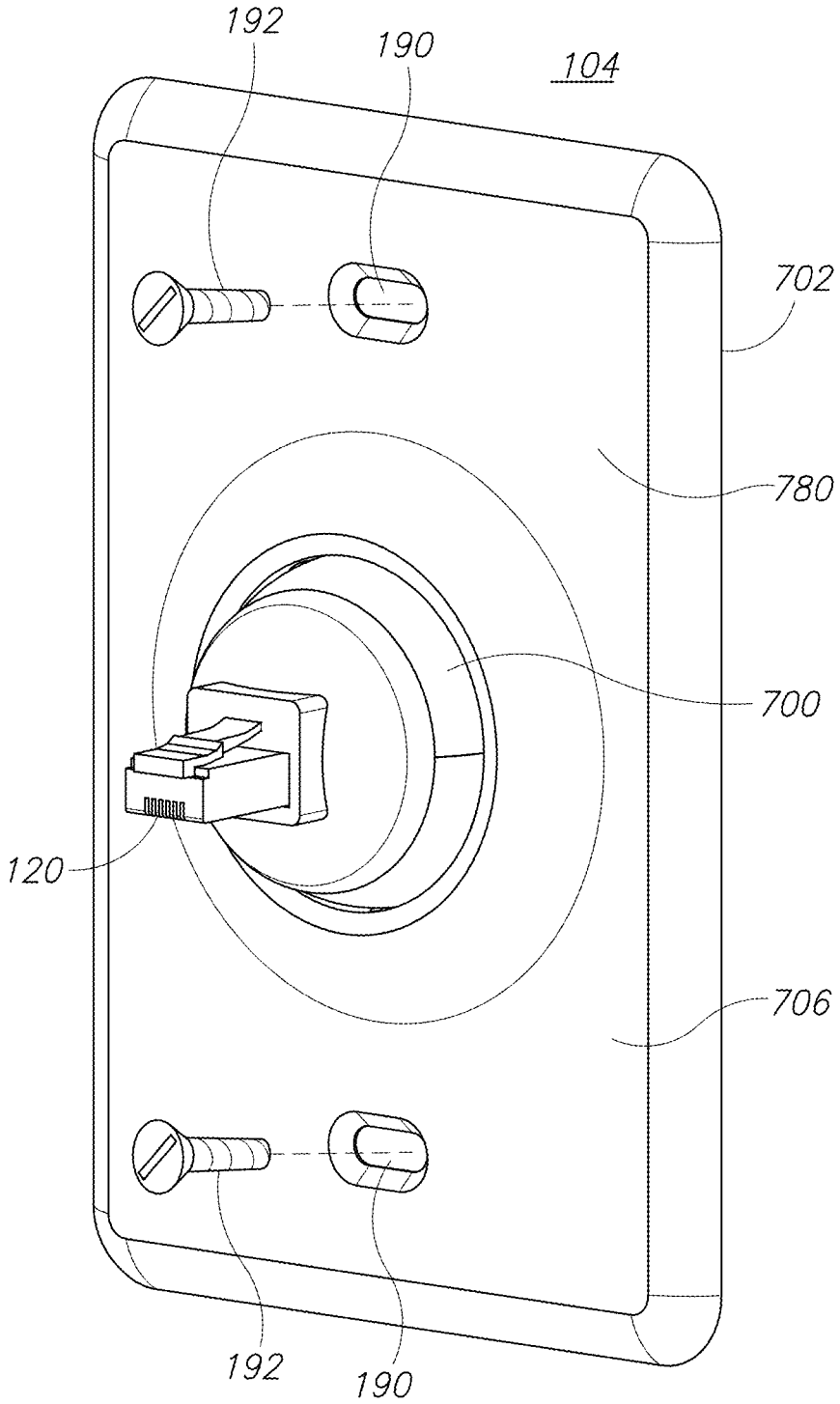
FIG. 23 is a perspective view of a front side of an eighth embodiment of the connector assembly mounted in a wall plate.
Figure 27:
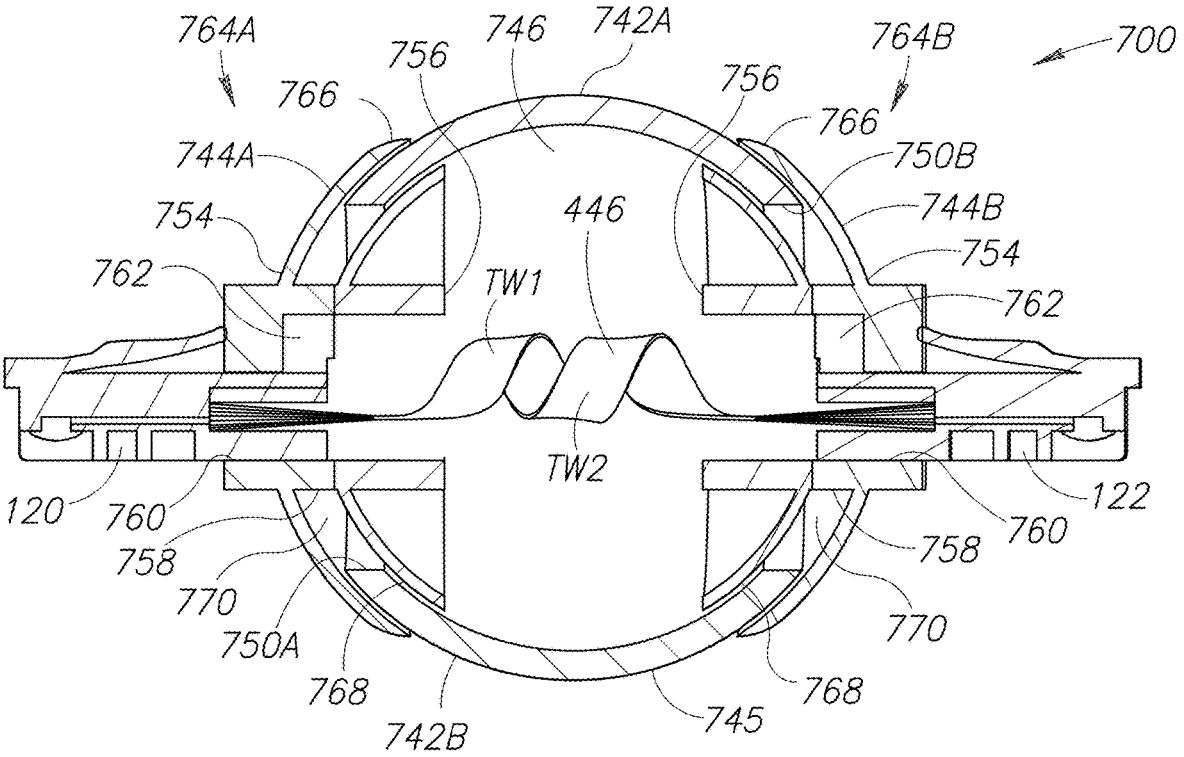
FIG. 27 is a cross-sectional side view of the eighth embodiment of the connector assembly.

FIG. 23 is a perspective view of a eighth embodiment of a connector assembly 700 mounted inside a wall plate 702 (which may be installed in the wall 104). The wall plate 702 has a front side 706 opposite a backside 708 (see FIG. 24). At the front side 706, the connector assembly 700 includes the first connector 120 (e.g., a plug or an outlet). Referring to FIG. 25, at the backside 708 (see FIG. 24), the connector assembly 700 may include the second connector 122 (e.g., a plug or an outlet) connected to the first connector 120. Referring to FIG. 27, the first and second connectors 120 and 122 are connected together electrically (inside the interior 746) by the flexible substrate 446 (described below). In the embodiment illustrated, both the first and second connectors 120 and 122 have been implemented as a plug. Alternatively, as in the connector assemblies 100, 200, 300, and 320 (see FIGS. 1, 7, 10, and 11, respectively), the first connector 120 may be connected to the cable 134 (see FIGS. 1-4B and 7-12), which, referring to FIG. 24, may extend outwardly from the backside 708 of the wall plate 702.

Referring to FIG. 25, the connector assembly 700 includes an outer housing 740 having a generally spherical outer shape. The outer housing 740 houses a portion of each of the first and second connectors 120 and 122, or alternatively, a portion of the first connector 120 and an end portion of the cable 134 (see FIGS. 1-4B and 7-12).

Figure 26:
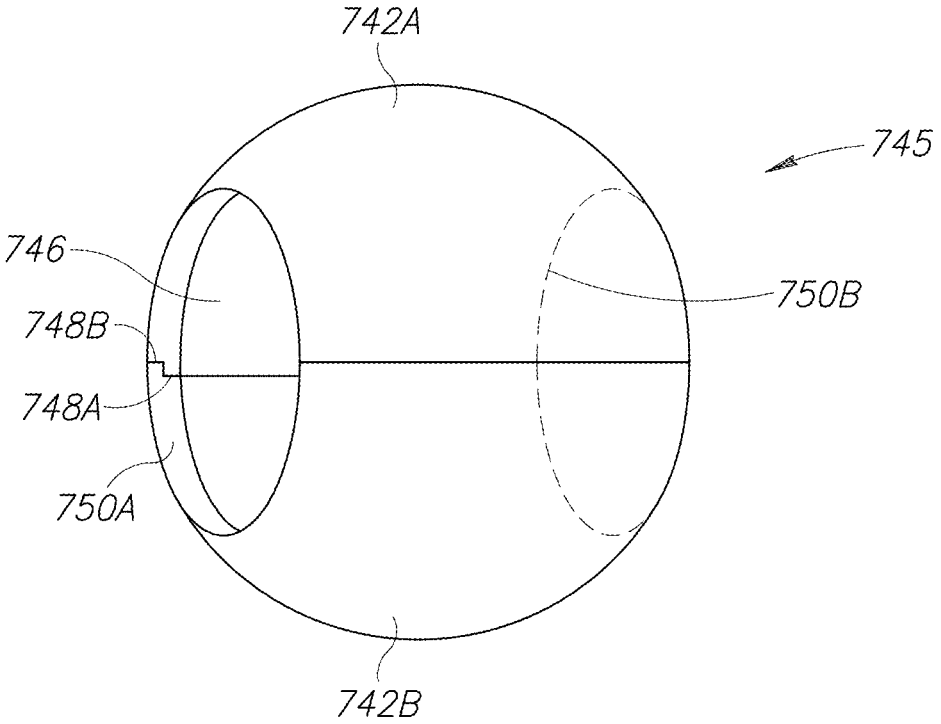
FIG. 26 is a side view of a shell of the eighth embodiment of the connector assembly.

The outer housing 740 may include first and second outer shell portions 742A and 742B and movable covers 744A and 744B. Referring to FIG. 26, the first and second outer shell portions 742A and 742B couple together to form a generally spherically shaped shell 745 having a generally hollow interior 746. In the embodiment illustrated, each of the first and second outer shell portions 742A and 742B has a generally hollow hemispherical shape. However, this is not a requirement. The first outer shell portion 742A has an inner lip 748A and the second outer shell portion 742B has an outer lip 748B. The inner and outer lips 748A and 748B are configured to engage one another and couple together. For example, the inner and outer lips 748A and 748B may snap together to form a snap fit. By way of another non-limiting example, the inner and outer lips 748A and 748B may form a friction fit, an interference fit, and the like. In some embodiments, the inner and outer lips 748A and 748B may be ultrasonically welded together.

The shell 745 includes openings 750A and 750B configured to receive the movable covers 744A and 744B (see FIGS. 25, 27, 30, 31, 33, 34, 39, and 41), respectively. In the embodiment illustrated, the openings 750A and 750B are positioned opposite one another along the shell 745. However, this is not a requirement. In the embodiment illustrated, a portion of each of the openings 750A and 750B is formed in each of the first and second outer shell portions 742A and 742B. However, this is also not a requirement.

Referring to FIG. 25, the covers 744A and 744B are substantially identical to one another. Therefore, for the sake of brevity, referring to FIGS. 28 and 29, only the cover 744A will be described in detail. Referring to FIG. 29, the cover 744A has an outer portion 754 opposite an inner portion 756. A connecting portion 758 connects the outer and inner portions 754 and 756.

Figure 28:
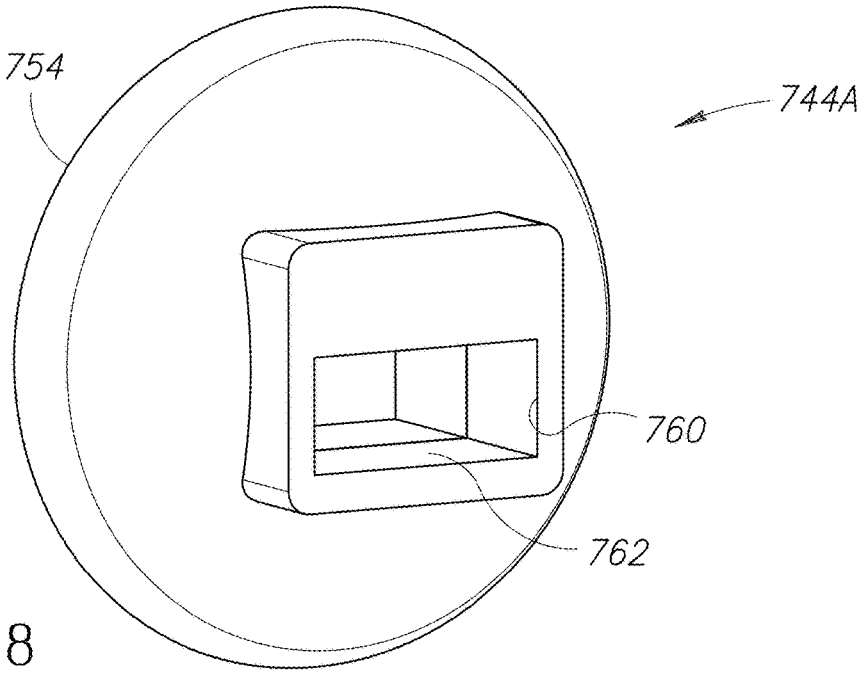
FIG. 28 is a perspective view of an outside portion of a first cover of the eighth embodiment of the connector assembly.
Figure 29:
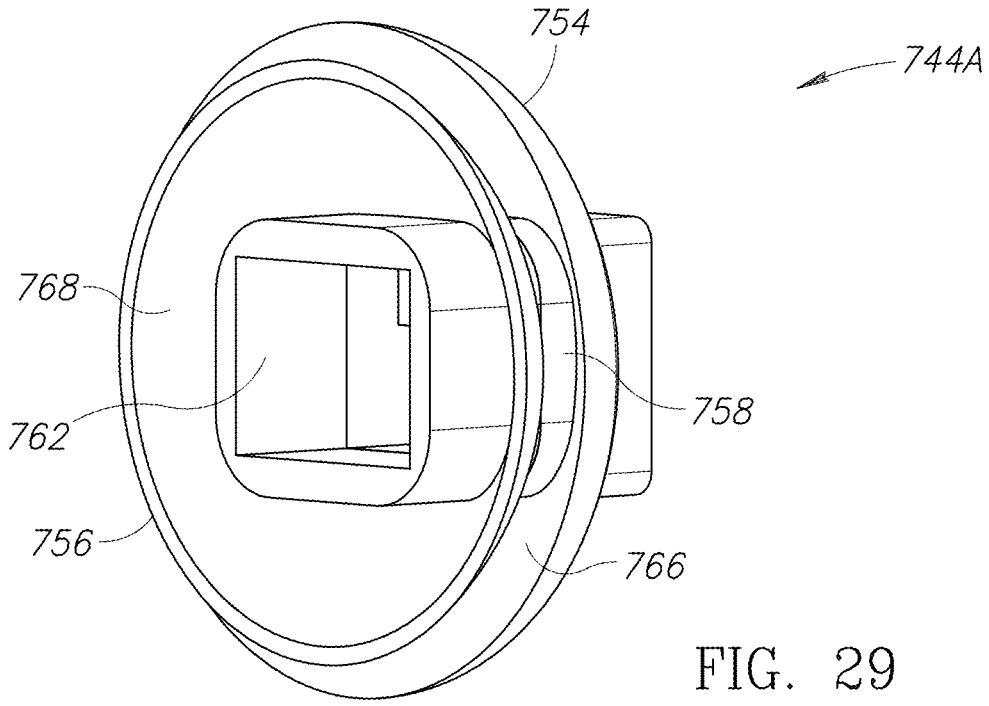
FIG. 29 is a perspective view of an inside portion of the first cover of the eighth embodiment of the connector assembly.

Referring to FIG. 28, the outer portion 754 has a through-hole 760 configured to receive the first connector 120 (see FIGS. 1, 3A-5, 7-23, 25, 27, 30-37, and 39-41). Similarly, referring to FIG. 27, the through-hole 760 of the cover 744B is configured to receive the second connector 122. The through-hole 760 is in communication with a through-channel 762 that extends from the through-hole 760 through the outer portion 754, the connecting portion 758, and the inner portion 756. The through-channel 762 opens into the interior 746.

A portion of the shell 745 alongside the opening 750A is received between the outer and inner portions 754 and 756 of the cover 744A. The outer portion 754 includes an outwardly extending portion 766 that extends circumferentially along an outside portion of the shell 745 alongside the opening 750A. The outwardly extending portion 766 of the cover 744A is configured to slide along the shell 745 and not to pass through the opening 750A. The inner portion 756 of the cover 744A includes an outwardly extending portion 768 that extends circumferentially along an inside portion of the shell 745 alongside the opening 750A. The outwardly extending portion 768 of the cover 744A is configured not to pass through the opening 750A.

Similarly, a portion of the shell 745 alongside the opening 750B is received between the outer and inner portions 754 and 756 of the cover 744B. The outwardly extending portion 766 of the cover 744B extends circumferentially along an outside portion of the shell 745 alongside the opening 750B. The outwardly extending portion 766 of the cover 744B is configured to slide along the shell 745 and not to pass through the opening 750B. The outwardly extending portion 768 of the cover 744B extends circumferentially along an inside portion of the shell 745 alongside the opening 750B. The outwardly extending portion 768 of the cover 744B is configured not to pass through the opening 750B.

Figure 30:
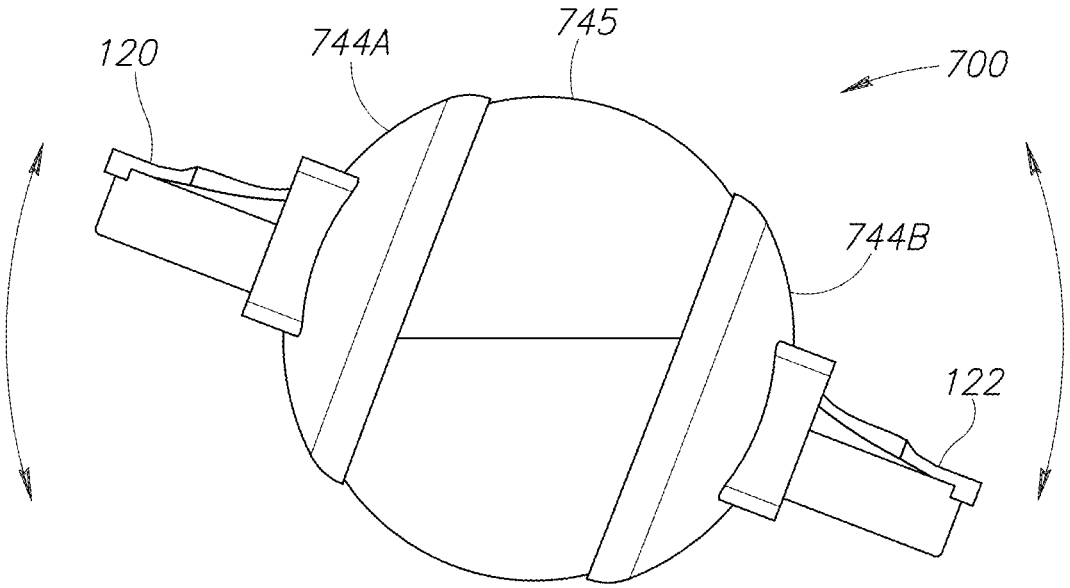
FIG. 30 is a side view of the eighth embodiment of the connector assembly with its first connector swiveled upward to a first position and its second connector swivel downward to a second position.
Figure 31:
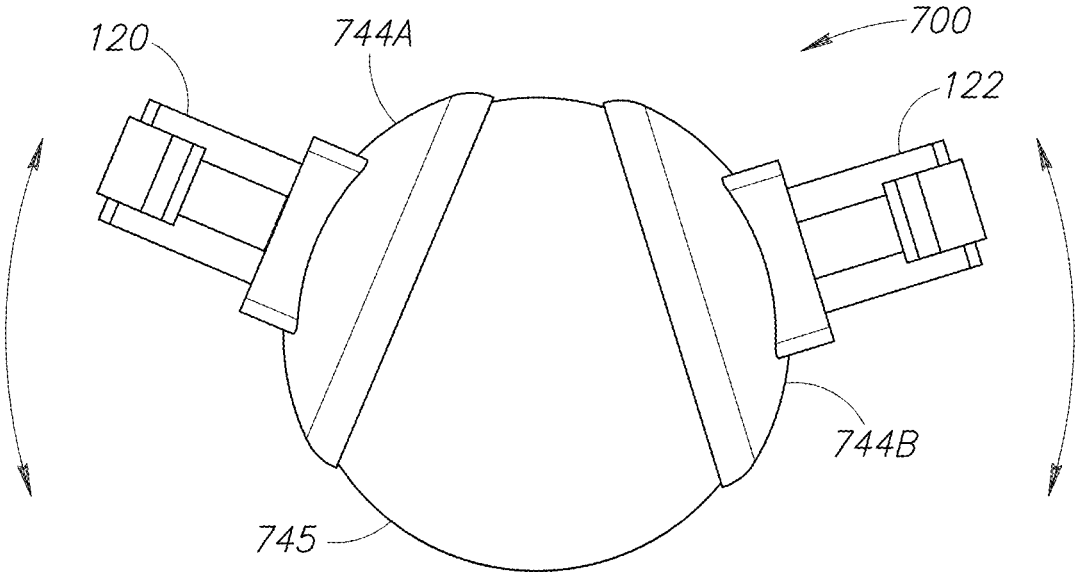
FIG. 31 is a top view of the eighth embodiment of the connector assembly with its first connector swiveled rearwardly to a third position and its second connector swiveled rearwardly to a fourth position.
Figure 32:
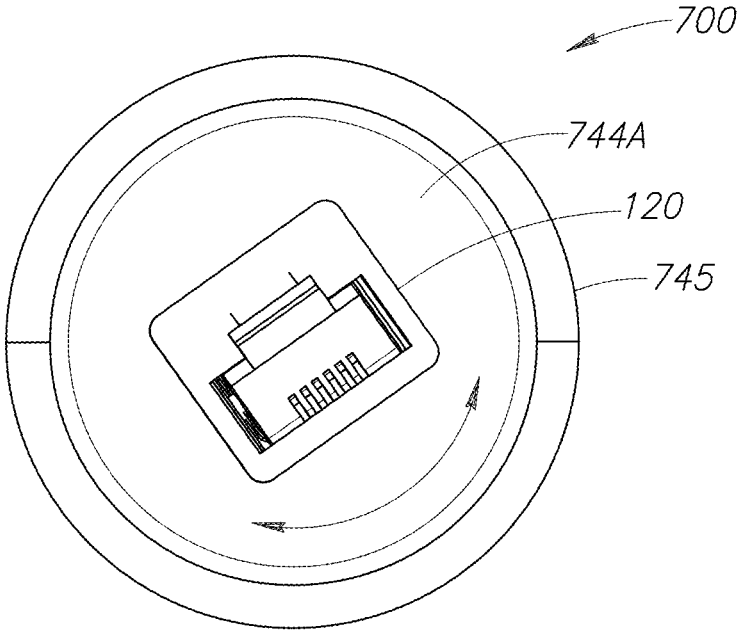
FIG. 32 is a front view of the eighth embodiment of the connector assembly with its first connector rotated to a fifth position.

The connecting portion 758 of the cover 744A is configured to be positioned inside the opening 750A and the connecting portion 758 of the cover 744B is configured to be positioned inside the opening 750B. The connecting portion 758 is smaller than the opening 750A (and the opening 750B) such that an annular gap 770 surrounds the connecting portion 758. As shown in FIGS. 30-32, the cover 744A is movable within the annular gap 770 (see FIG. 27) formed inside the opening 750A (see FIGS. 26 and 27) along any direction to position the first connector 120 is a desirable position. Similarly, the cover 744B is movable within the annular gap 770 (see FIG. 27) formed inside the opening 750B (see FIGS. 26 and 27) along any direction to position the second connector 122 is a desirable position. Referring to FIG. 32, the cover 744A may be rotatable within the opening 750A (see FIGS. 26 and 27). Similarly, referring to FIG. 27, the cover 744B may be rotatable within the opening 750B. Thus, each of the covers 744A and 744B may be characterized as swiveling with respect to the shell 745. However, as is apparent to those of ordinary skill in the art, rotation of the covers 744A and 744B with respect to the shell 745 may be limited to prevent breakage.

Referring to FIG. 27, each of the movable covers 744A and 744B may be characterized as being a socket configured to receive a portion of the generally spherical (or ball shaped) shell 745. Thus, the movable cover 744A and the shell 745 together may be characterized as forming a first ball joint 764A or swivel-type connection. Similarly, the movable cover 744B and the shell 745 together may be characterized as forming a second ball joint 764B or swivel-type connection. Thus, each of the covers 744A and 744B may be rotatable circumferentially about a portion of the shell 745.

Figure 24:
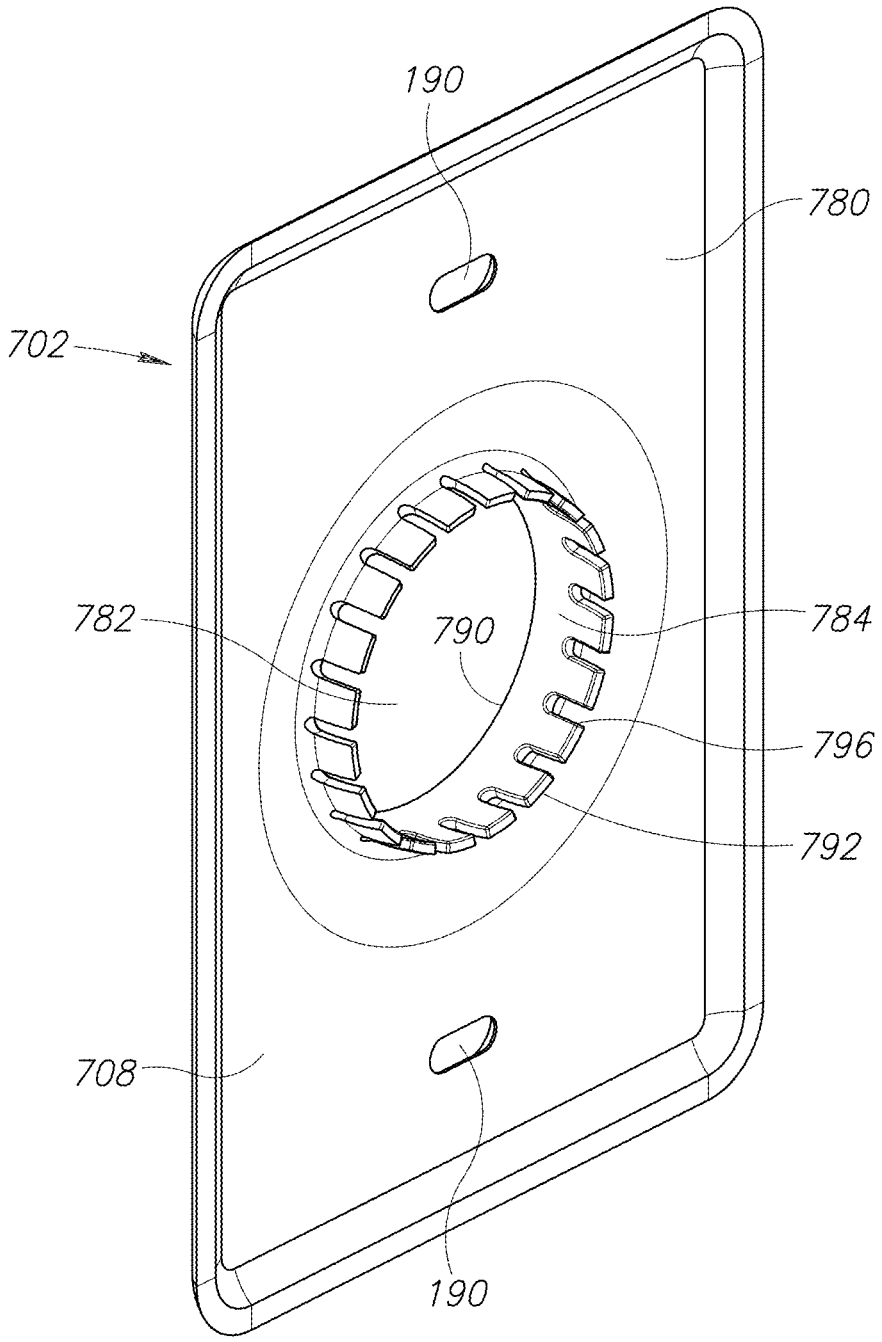
FIG. 24 is a rear view of the wall plate of FIG. 23.
Figure 25:
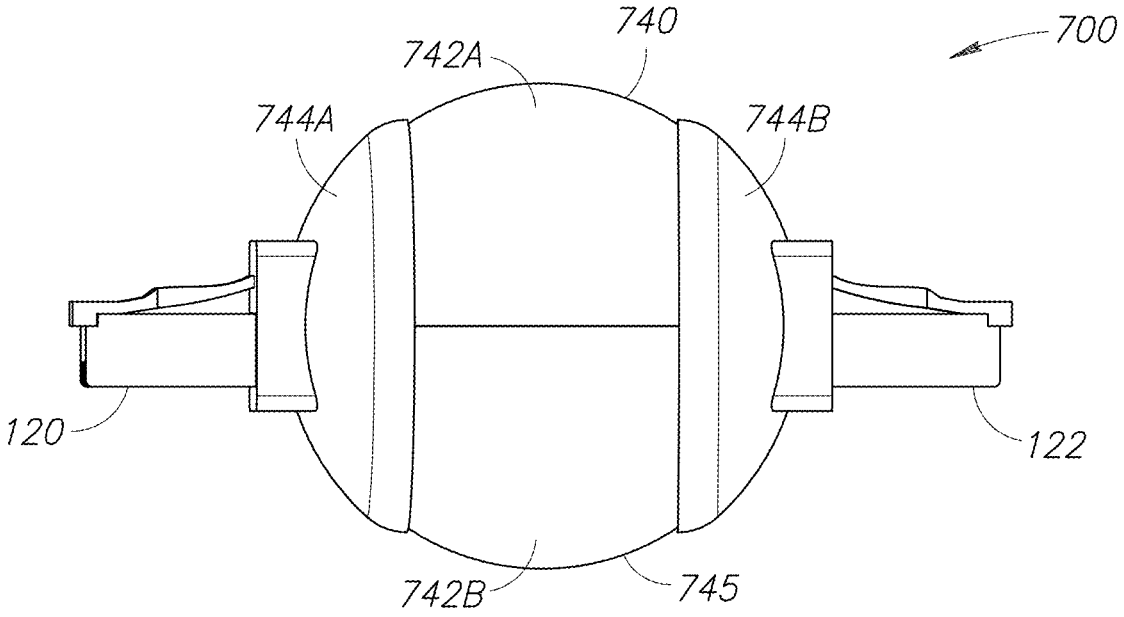
FIG. 25 is a side view of the eighth embodiment of the connector assembly.
Figure 33:
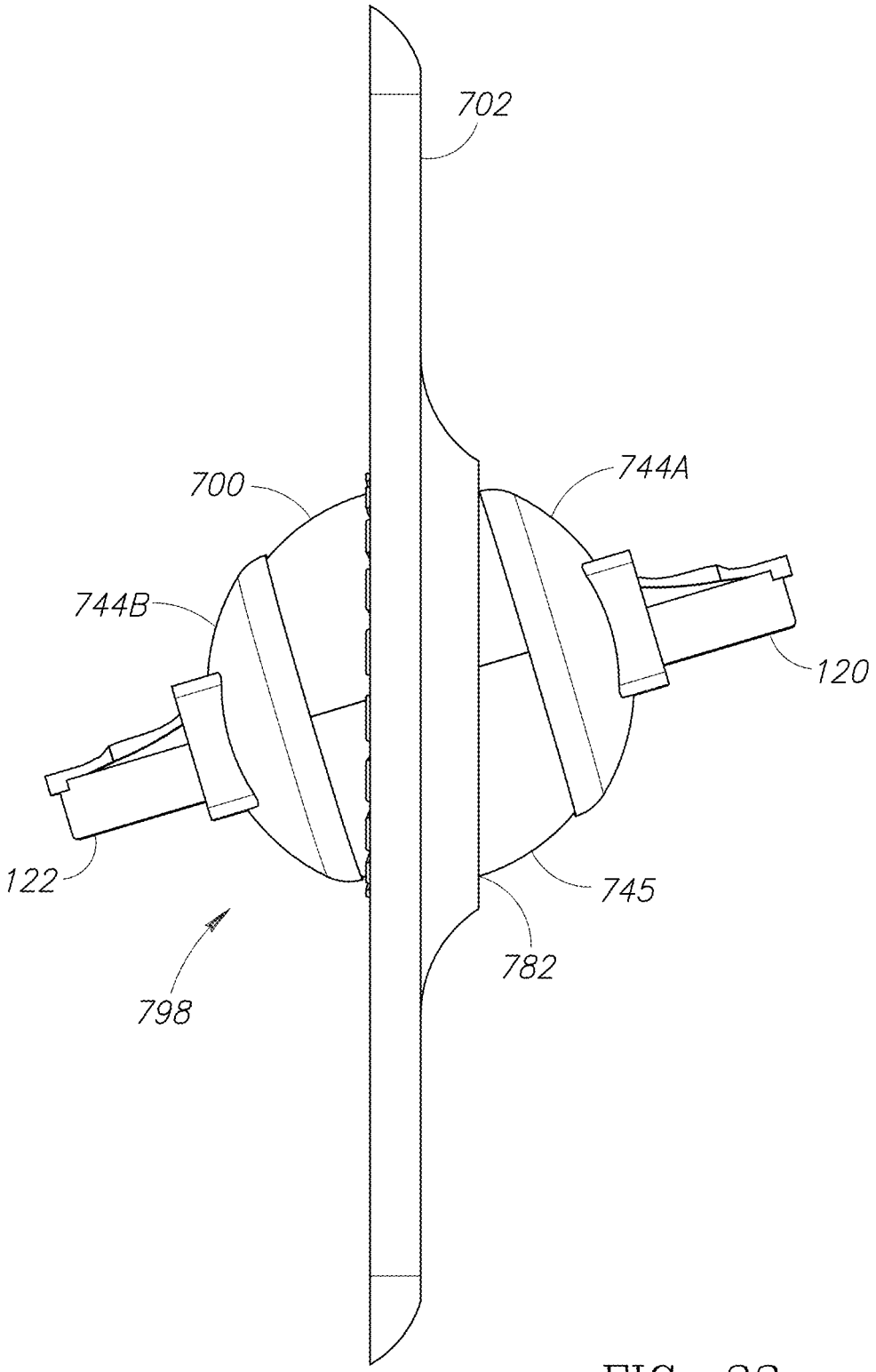
FIG. 33 is a side view of the eighth embodiment of the connector assembly rotated with respect to the wall plate to position its first connector to face upwardly and its second connector to face downwardly.
Figure 34:
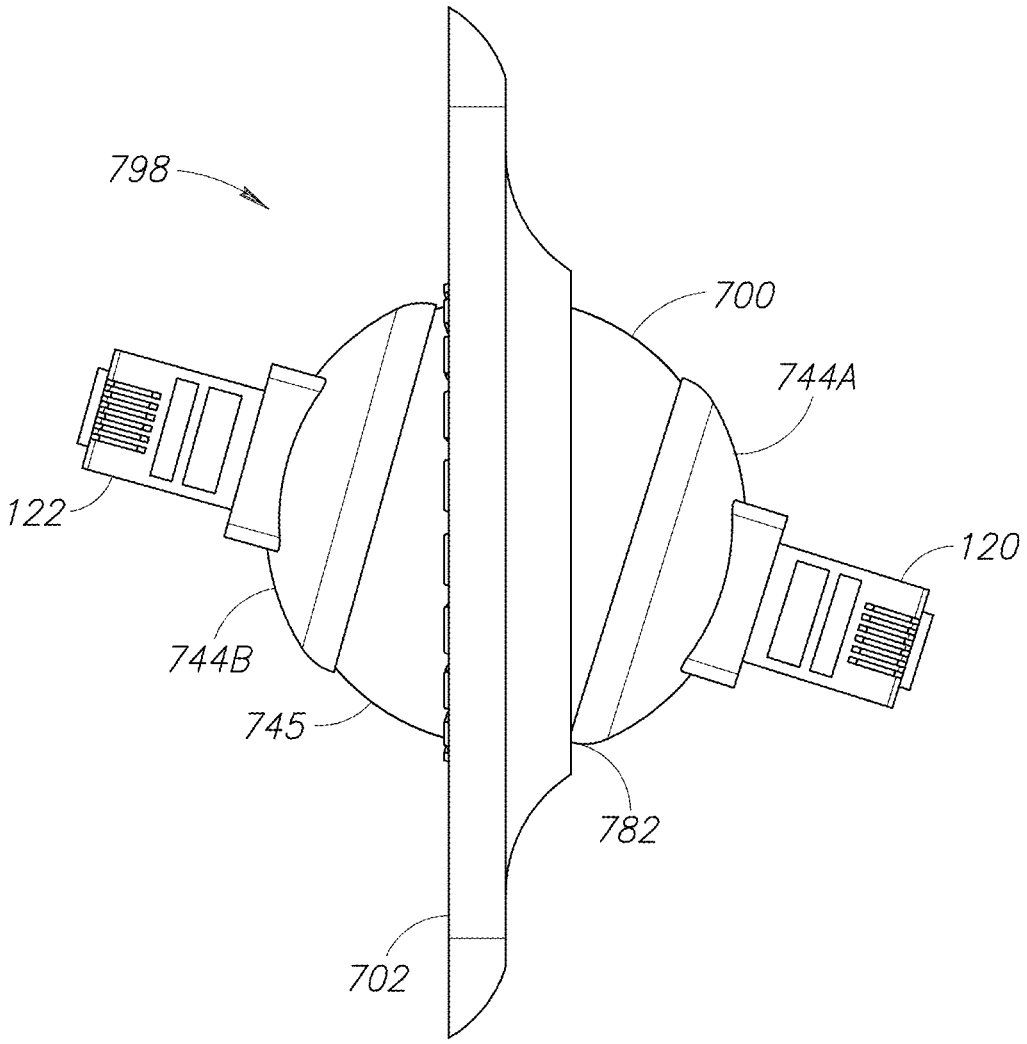
FIG. 34 is a side view of the eighth embodiment of the connector assembly rotated with respect to the wall plate to position its first connector to face toward the left side and its second connector to face toward the right side.

Referring to FIG. 24, the wall plate 702 includes a substantially planar body portion 780 with a through-hole 782 formed therein. The through-hole 782 is configured to receive the shell 745 (see FIGS. 25-27, 30-34, 37, 39, and 41) of the connector assembly 700. Thus, the through-hole 782 has a generally round outer shape. The through-hole 782 is defined by a sidewall portion 784 of the wall plate 702. In the embodiment illustrated, portions 790 and 792 of the sidewall portion 784 extends forwardly and rearwardly, respectively, with respect to the body portion 780. Free ends of the portions 790 and 792 may be angled or curved toward the through-hole 782 to help retain the shell 745 (see FIGS. 25-27, 30-34, 37, 39, and 41) therein. The rearwardly extending portion 792 may include one or more slots or cutouts 796 that allow the rearwardly extending portion 792 to bend or flex outwardly to allow the shell 745 (see FIGS. 25-27, 30-34, 37, 39, and 41) to be placed inside the through-hole 782. The shell 745 (see FIGS. 25-27, 30-34, 37, 39, and 41) may be rotatable inside the through-hole 782 or fixedly attached (e.g., with a friction fit, a snap-fit, or notched/grooved for discrete positioning) inside the sidewall portion 784 of the wall plate 702. Referring to FIGS. 33 and 34, in embodiments in which the shell 745 is rotatable inside the through-hole 782 (see FIG. 24), the through-hole 782 may be characterized as being a socket configured to receive the generally spherical (or ball shaped) shell 745. Thus, together, the shell 745 and the wall plate 702 may be characterized as forming a ball joint 798 (see FIG. 33).

Referring to FIG. 23, the body portion 780 may include the one or more through-holes 190 each configured to receive the fastener 192 that fastens the wall plate 702 to the wall 104 or a wall box (not shown) recessed in the wall 104.

Ninth Embodiment

Figure 35:
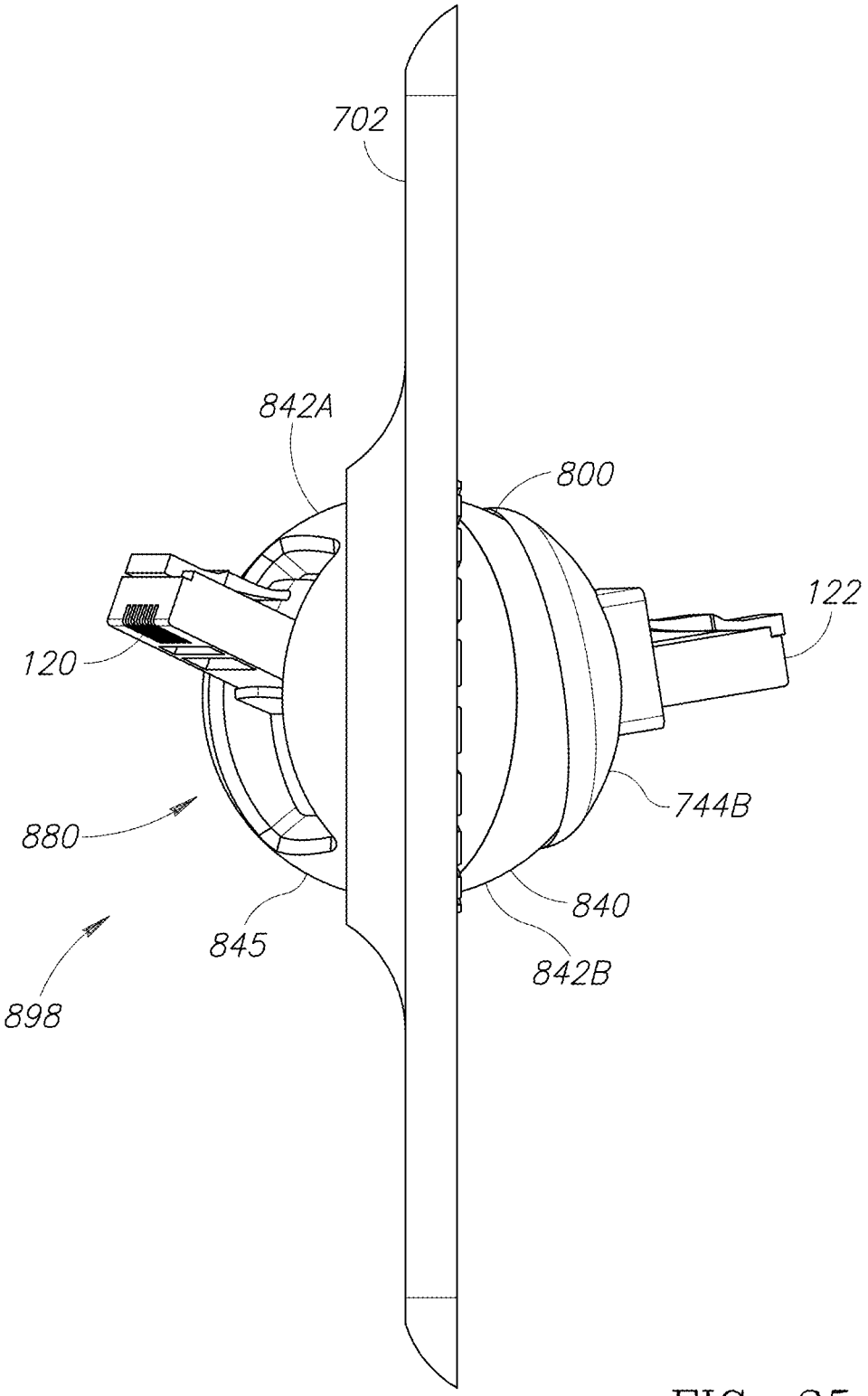
FIG. 35 is a side view of a ninth embodiment of the connector assembly mounted in a wall plate.
Figure 36:
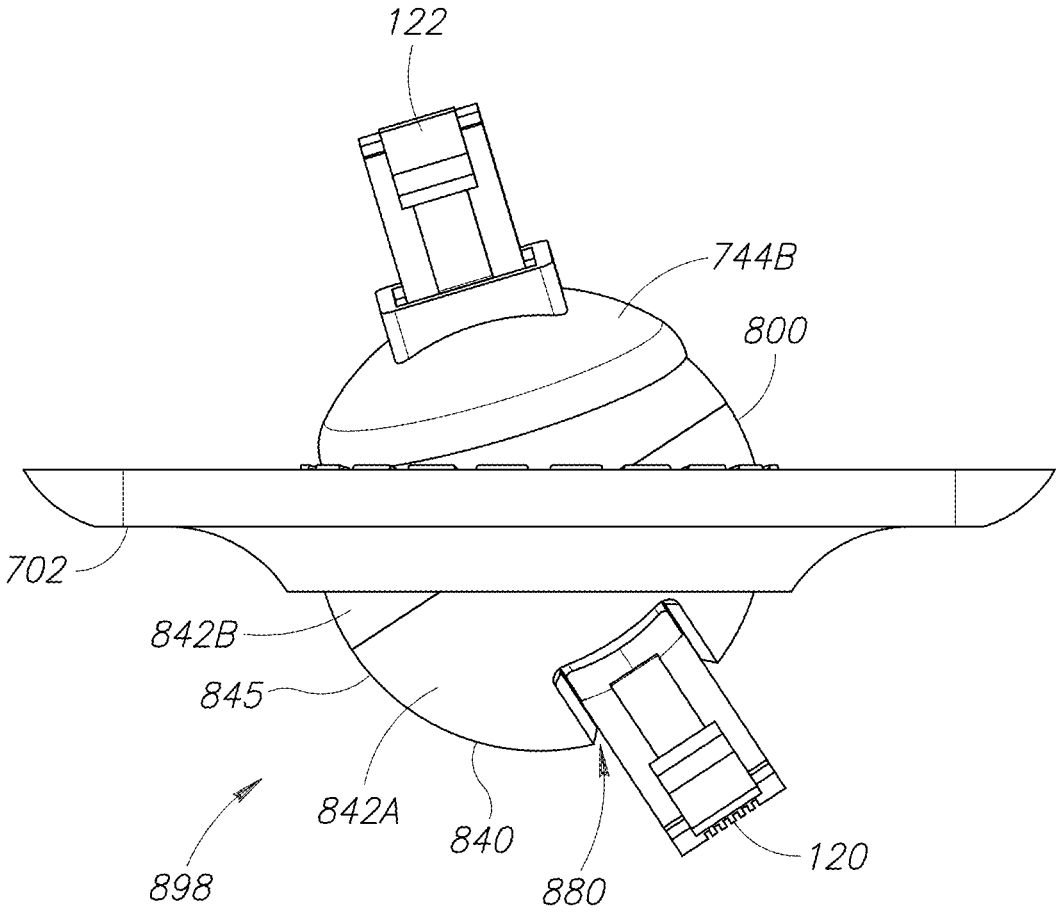
FIG. 36 is a top view of the ninth embodiment of the connector assembly mounted in the wall plate.
Figure 37:
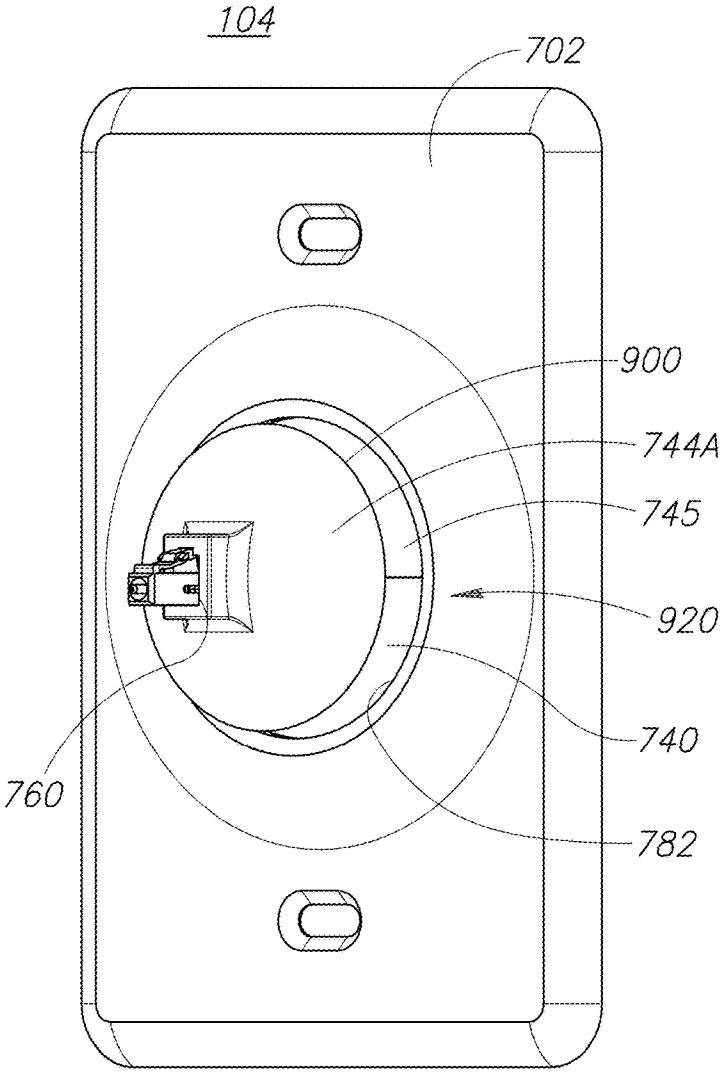
FIG. 37 is a front perspective view of a tenth embodiment of the connector assembly.

FIGS. 35 and 36 are perspective views of a ninth embodiment of a connector assembly 800 mounted inside the wall plate 702 (which may be installed in the wall 104 as illustrated in FIGS. 23 and 37). The connector assembly 800 includes an outer housing 840 that differs from the outer housing 740 (see FIG. 25) in only a few respects. First, the outer housing 840 includes a track 880 in place and instead of the opening 750A (see FIGS. 26 and 27) and the cover 744A (see FIGS. 25, 27-34, 37, 39, and 41). The track 880 is substantially identical to the track 380 (see FIGS. 9A-10, 14, and 19-21). Like the outer housing 740 (see FIGS. 25 and 37-39), the outer housing 840 includes a shell 845 formed by first and second outer shell portions 842A and 842B. However, the first and second outer shell portions 842A and 842B are configured to join together orthogonally to the direction in which the first and second outer shell portions 442A and 442B (see FIGS. 25-27) join together. The track 380 is formed in the first outer shell portion 842A and an opening (like the opening 750B illustrated in FIGS.

26 and 27) is formed in the second outer shell portion 842B. The opening (not shown), which is substantially identical to the opening 750B (see FIGS. 26 and 27), is configured to receive the cover 744B (which is configured to receive the second connector 122).

In the embodiment illustrated, both the first and second connectors 120 and 122 have been implemented as a plug. However, in alternate embodiments, one or both of the first and second connectors 120 and 122 may be implemented as an outlet. The first and second connectors 120 and 122 are connected together electrically by the flexible substrate 446 (illustrated in FIGS. 12, 14, 20, 27, and 42 and described below).

In alternate embodiments, the outer housing 840 may include a second track (not shown) in place and instead of the opening (like the opening 750B illustrated in FIGS. 26 and 27) and the cover 744B. In such embodiments, instead of including the track 880, the outer housing 840 may include the cover 744B (see FIGS. 25, 27, 30, 31, 33-36, and 38-41) and an opening (not shown) substantially identical to the opening 750A (see FIGS. 26 and 27). The second track (not shown) may be substantially identical to the second track 450 (see FIGS. 13-18, 20, and 22).

Referring to FIGS. 35 and 36, the shell 845 may be rotatable inside the through-hole 782 (see FIG. 24) or fixedly attached (e.g., with a friction fit) inside the sidewall portion 784 (see FIG. 24) of the wall plate 702. In embodiments in which the shell 845 is rotatable inside the through-hole 782 (see FIG. 24), the through-hole 782 may be characterized as being a socket configured to receive the generally spherical (or ball shaped) shell 845. Thus, together, the shell 845 and the wall plate 702 may be characterized as forming a ball joint 898 (see FIG. 23).

Tenth Embodiment

Figure 38:
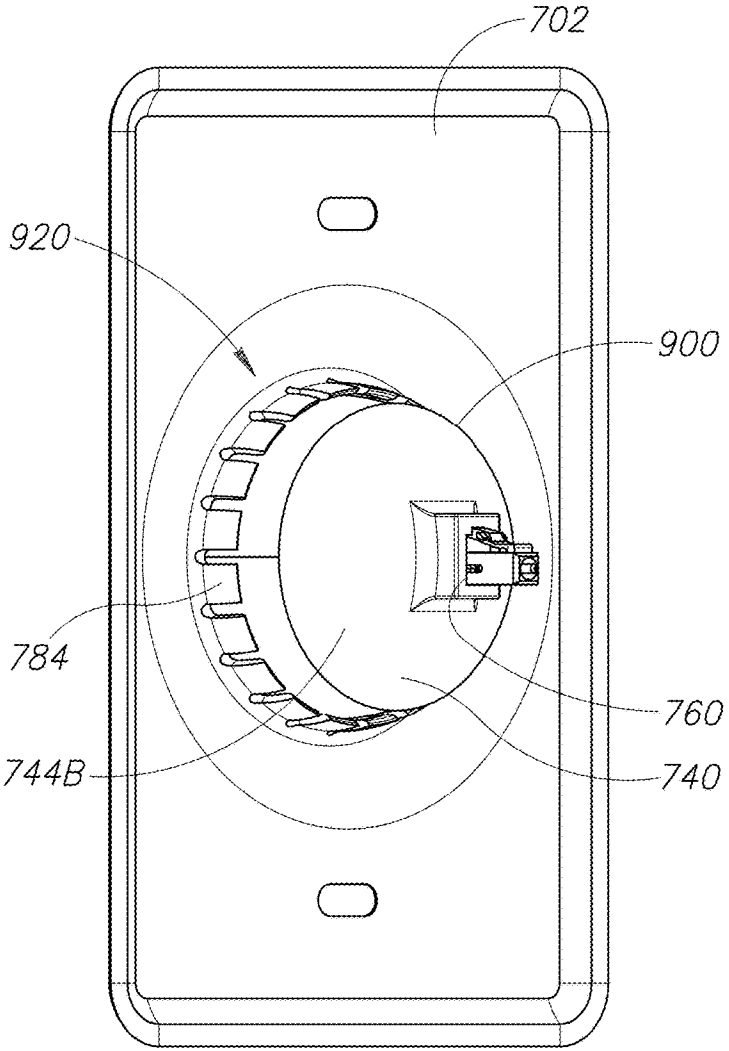
FIG. 38 is a rear perspective view of the tenth embodiment of the connector assembly.

FIGS. 37 and 38 are front and rear perspective views, respectively, of a tenth embodiment of a connector assembly 900. The connector assembly 900 is substantially identical to the connector assembly 700 (see FIGS. 23, 25, 27, and 30-34). However, in the connector assembly 900, the first and second connectors 120 and 122 are each implemented as a fiber optic connector. In some embodiments, the second connector 122 may be replaced the cable 134 (see FIGS. 1-4B and 7-12), which is implemented as a fiber optic cable.

By way of non-limiting examples, in the connector assembly 900, one or both of the first and second connectors 120 and 122 may be implemented as a small form factor ("SFF") style connector (e.g., a Lucent Connector ("LC") style connector, a Mechanical Transfer Registered Jack ("MT-RJ") style connector, and the like), a Subscriber Connector ("SC") style connector, a Straight Tip ("ST") style connector, a FC style connector, a fiber distributed data interface ("FDDI") style connector, an ESCON style connector, a MU style connector, an E2000 style connector, a "fiber jack" style connector (e.g., an Opti-Jack connector manufactured by Panduit), a ribbon fiber style connector (e.g., a MT connector, a 25 MTP connector, a Multi-fiber Push-On ("MPO") connector, and the like), and the like.

Figure 39:
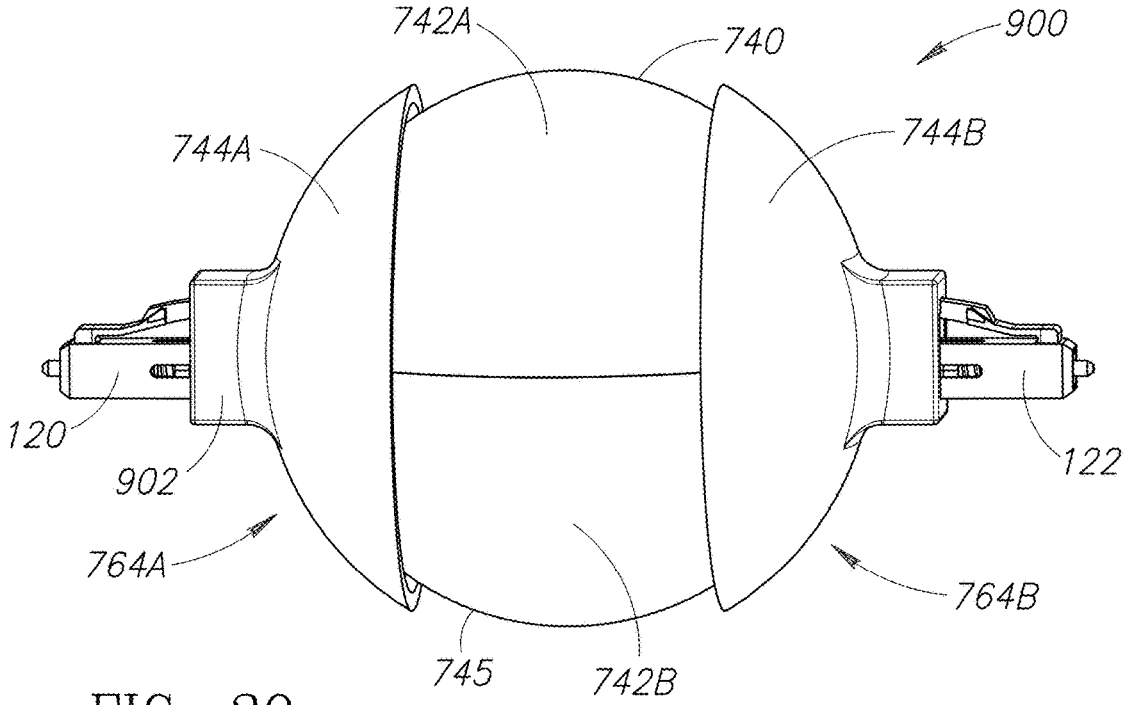
FIG. 39 is a side perspective view of the tenth embodiment of the connector assembly.

Referring to FIG. 39, the connector assembly 900 includes the outer housing 740 that houses a portion of each of the first and second connectors 120 and 122, or alternatively, a portion of the first connector 120 and an end portion of the cable 134 (see FIGS. 1-4B and 7-12). As described above, the outer housing 740 includes the first and second outer shell portions 742A and 742B and the movable covers 744A and 744B.

Figure 40:
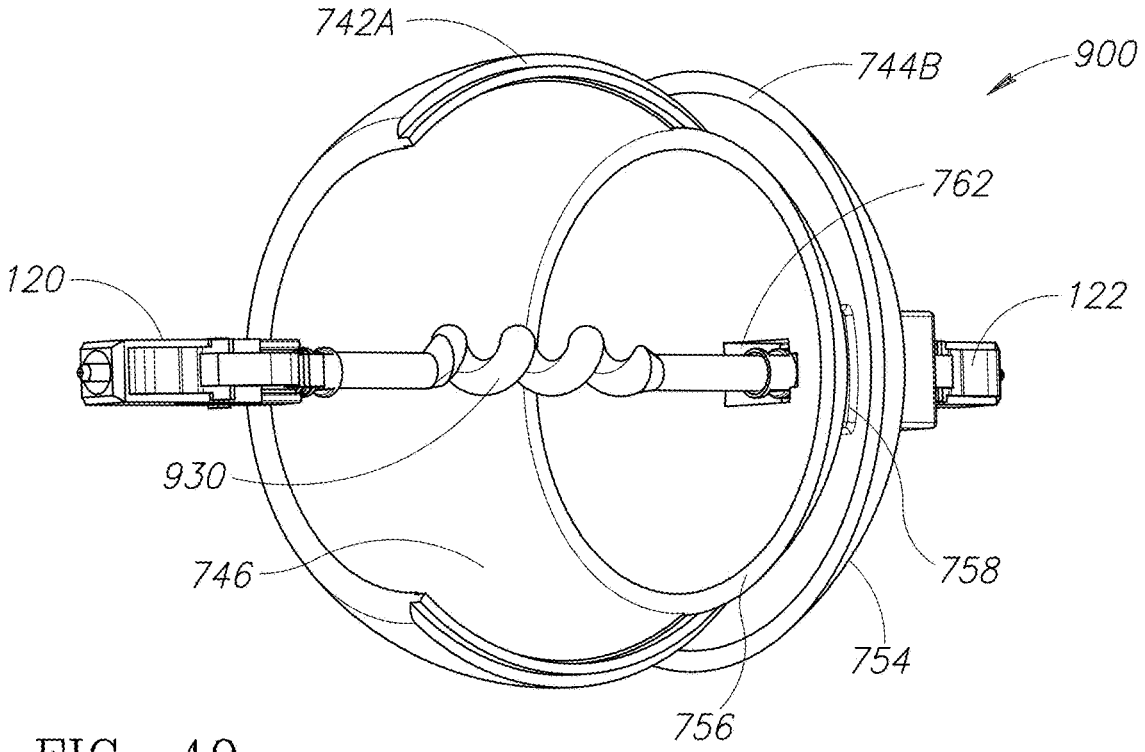
FIG. 40 is a bottom front perspective view of the tenth embodiment of the connector assembly omitting a first outer shell portion and a movable cover to reveal a generally hollow interior inside the connector assembly.

The first and second outer shell portions 742A and 742B couple together to form the shell 745 with the hollow interior 746 (see FIG. 40). Referring to FIG. 37, the movable cover 744A includes the through-hole 760 configured to receive the first connector 120. Similarly, referring to FIG. 38, the movable cover 744B includes the through-hole 760 configured to receive the second connector 122. Referring to FIG. 40, the through-holes 760 (see FIGS. 37 and 38) are in communication with the through-channel 762 that opens into the interior 746.

Referring to FIG. 39, each of the movable covers 744A and 744B may be characterized as being a socket configured to receive a portion of the generally spherical (or ball shaped) shell 745. Thus, the movable cover 744A and the shell 745 together may be characterized as forming the first ball joint 764A or swivel-type connection. Similarly, the movable cover 744B and the shell 745 together may be characterized as forming the second ball joint 764B or swivel-type connection.

Referring to FIG. 37, the connector assembly 900 may be mounted inside the wall plate 702 (which may be installed in the wall 104). In such embodiments, the shell 745 may be rotatable inside the through-hole 782 or fixedly attached (e.g., with a friction fit, a snap-fit, or notched/grooved for discrete positioning) inside the sidewall portion 784 (see FIG. 38) of the wall plate 702. In embodiments in which the shell 745 is rotatable inside the through-hole 782, the through-hole 782 may be characterized as being a socket configured to receive the generally spherical (or ball shaped) shell 745. Thus, together, the shell 745 and the wall plate 702 may be characterized as forming a ball joint 920. Alternatively, the connector assembly 900 may be used without the wall plate 702.

Referring to FIG. 40, inside the hollow interior 746, the first and second connectors 120 and 122 may be connected together optically by a coiled or helically shaped segment of optical fiber 930 (e.g., a short, flexible segment of optical patch cord). In embodiments in which the second connector is replaced with the cable 134 (see FIGS. 1-4B and 7-12), the cable 134 may be connected directly to the first connector 120.

In alternate embodiments, the connector assembly 900 may include a flexible substrate (not shown) instead and in place of the segment of optical fiber 930. The flexible substrate (not shown) of the connector assembly 900 may be substantially similar to the flexible substrate 446. However, instead of connecting the first and second connectors 120 and 122 together electrically as described below, the flexible substrate (not shown) of the connector assembly 900 may couple the first and second connectors 120 and 122 together optically. Thus, the flexible substrate (not shown) of the connector assembly 900 may include light transmitting elements (like those included in the segment of optical fiber 930) configured to transmit optical signals between the first and second connectors 120 and 122. The flexible substrate (not shown) of the connector assembly 900 includes a different transmission pathway for each signal transmitted by the flexible substrate.

Eleventh Embodiment

Figure 41:
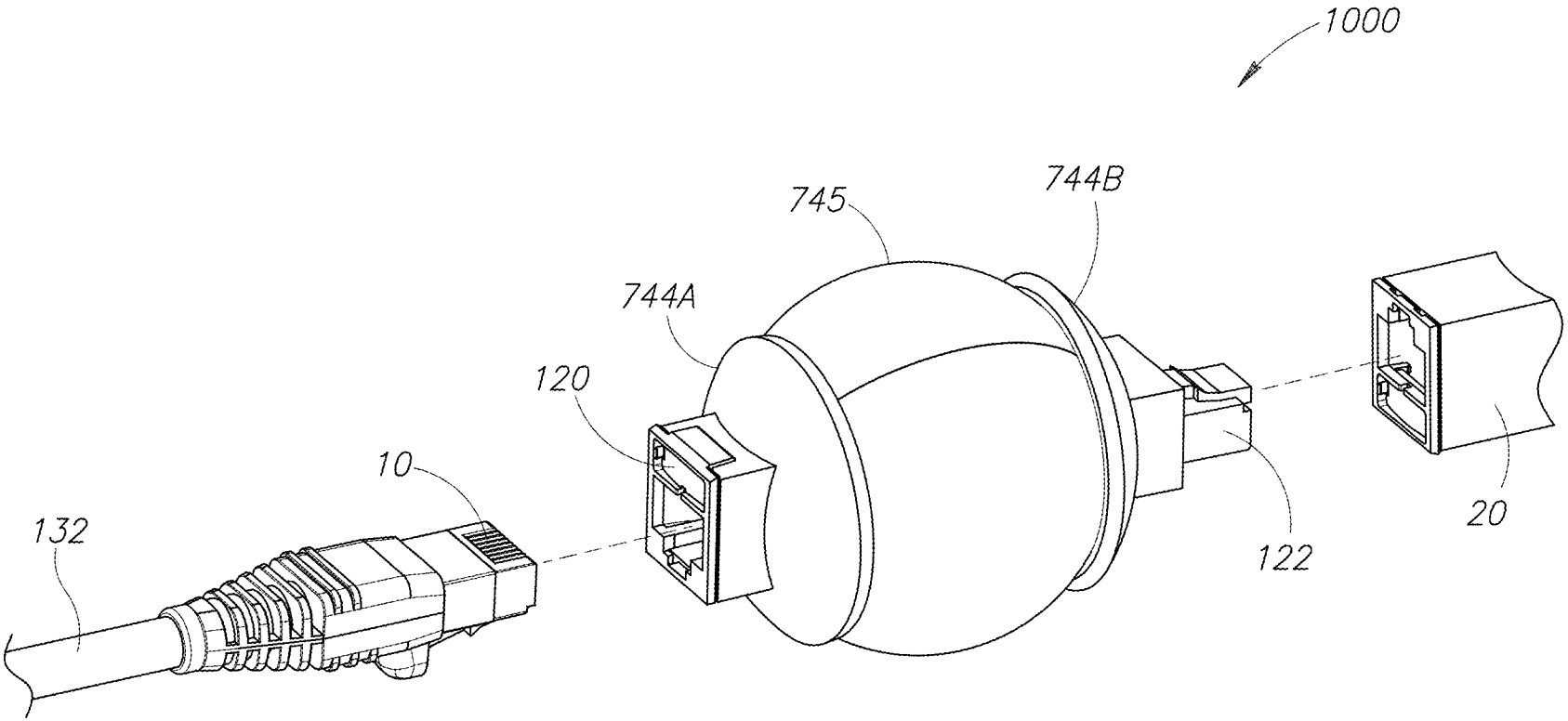
FIG. 41 is a perspective view of a side of an eleventh embodiment of the connector assembly.

FIG. 41 is a perspective view of an eleventh embodiment of a connector assembly 1000 configured to be used without a wall plate. The connector assembly 1000 is substantially identical to the connector assembly 700 (see FIGS. 23, 25, 27, and 30-34). However, in the embodiment illustrated, the first connector 120 has been implemented as an outlet instead of a plug. As mentioned above, the first and second connectors 120 and 122 may each be implemented as either a plug or an outlet. The first and second connectors 120 and 122 are connected together electrically by the flexible substrate 446 (illustrated in FIGS. 12, 14, 20, 27, and 42 and described below). In some embodiments, either the first connector 120 or the second connector 122 may be replaced with a cable (not shown) that is substantially identical to the cable 134 (see FIGS. 1-4B and 7-12).

The connector assembly 1000 allows more than one degree of freedom with respect to a swivel-type connection formed with either of the first and second connectors 120 and 122. The connector assembly 1000 is configured such that the first and second connectors 120 and 122 may be rotated about multiple axes.

The connector assembly 1000 may be used to improve connectability in a tight enclosed space (e.g., between a communication device and a communication link). For example, embodiments of the connector assembly 1000 in which both the first and second connectors 120 and 122 have both been implemented as plugs (e.g., like the plug 10) may be used to connect an outlet end of a permanent link directly to an outlet of a communication device (without a patch cord). The first and second connectors 120 and 122 (which may be implemented as RJ-45 communication plugs) may be joined together by the flexible substrate 446 (illustrated in FIGS. 12, 14, 20, 27, and 42 and described below) which determines a fixed or predetermined distance there between. The predetermined distance may be set to facilitate mechanical connections between the first and second connectors 120 and 122 and two corresponding outlets (e.g., each like the outlet 20) as well as to improve electrical performance there between.

Flexible Substrate

As mentioned above, referring to FIG. 27, embodiments of the connector assembly (e.g., the connector assemblies 400, 500, 600, 700, 800, and 1000 illustrated in FIGS. 13, 20, 21, 25, 35, and 41, respectively) that include both the first and second connectors 120 and 122 may also include the flexible substrate 446 configured to provide an electrical connection between the first and second connectors 120 and 122. Similarly, referring to FIG. 12, embodiments of the connector assembly (e.g., the connector assembly 320) that include only the first connector 120 may include the flexible substrate 446 configured to provide an electrical connection between the first connector 120 and the cable 134.

For illustrative purposes, the flexible substrate 446 will be described with respect to the first and second connectors 120 and 122, which will each be described as being implemented as plugs. Such a connector assembly may be connected to a pair of communications outlets (e.g., each like the outlet 20 illustrated in FIG. 41). However, through application of ordinary skill in the art to the present teachings, the flexible substrate 446 may be used in connector assemblies in which one of the first and second connectors 120 and 122 is a plug and the other is an outlet or in which both of the first and second connectors 120 and 122 are outlets. Similarly, the flexible substrate 446 may be used in connector assemblies (e.g., the connector assembly 320 illustrated in FIGS. 11 and 12) in which the first connector 120 is a plug or an outlet connected to the cable 134.

Figure 42:
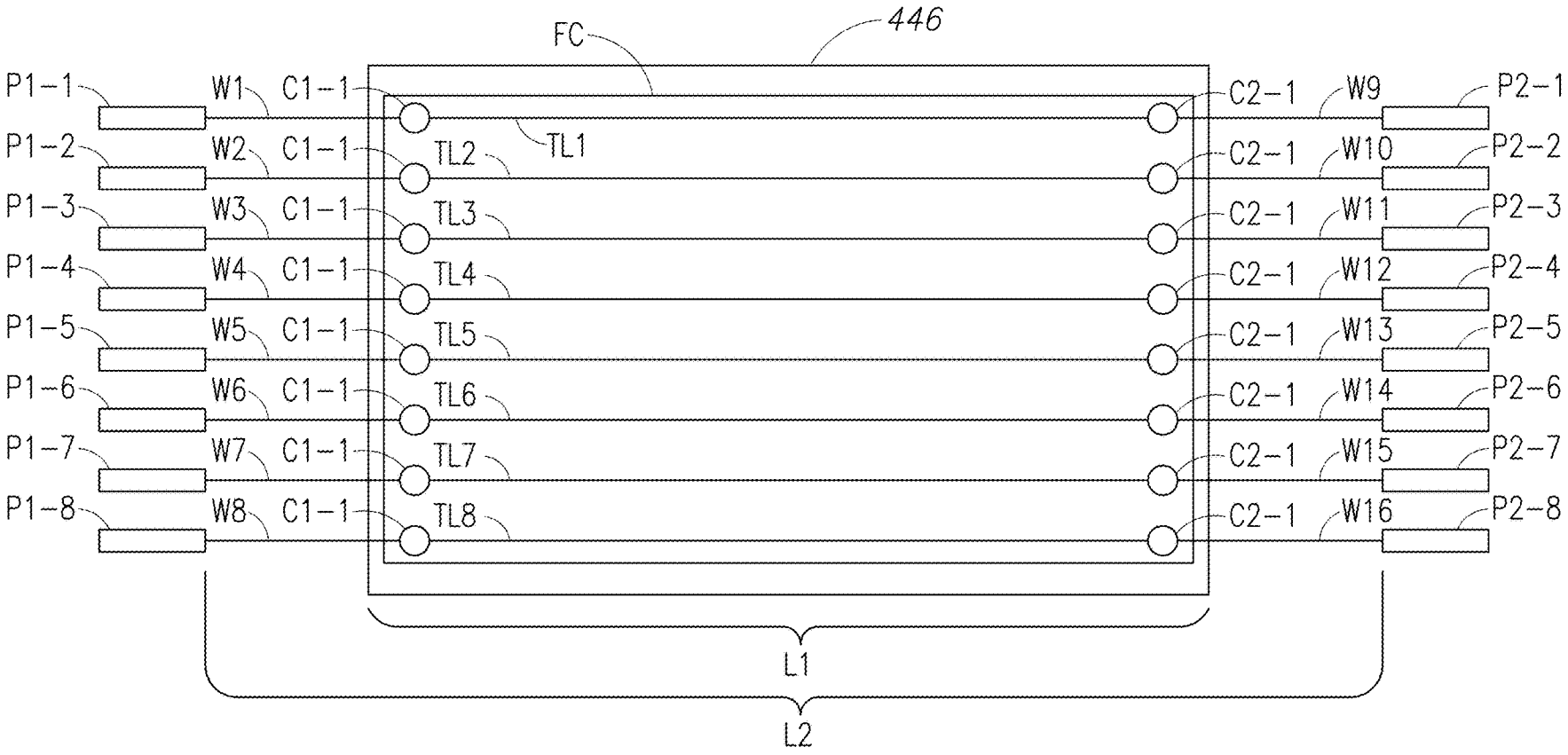
FIG. 42 is a block diagram of a flexible substrate having an electrical circuit including conductors that connect a plurality of first contacts of a first connector to a plurality of second contacts of a second connector.

Referring to FIG. 27, as is apparent to those of ordinary skill in the art, the first connector 120 includes a plurality of contacts P1-1 to P1-8 (see FIG. 42) and the second connector 122 includes a plurality of contacts P2-1 to P2-8 (see FIG. 42). In embodiments in which the first connector 120 is implemented as a plug, the contacts P1-1 to P1-8 (see FIG. 42) are configured to mate with a corresponding plurality of contacts (not shown) in an outlet (e.g., like the outlet 20 illustrated in FIG. 41). On the other hand, in embodiments in which the first connector 120 is implemented as an outlet, the contacts P1-1 to P1-8 (see FIG. 42) are configured to mate with a corresponding plurality of contacts (not shown) in a plug (e.g., like the plug 10 illustrated in FIG. 41). Similarly, in embodiments in which the second connector 122 is implemented as a plug, the contacts P2-1 to P2-8 (see FIG. 42) are configured to mate with a corresponding plurality of contacts (not shown) in an outlet (e.g., like the outlet 20 illustrated in FIG. 41). On the other hand, in embodiments in which the second connector 122 is implemented as an outlet, the contacts P2-1 to P2-8 (see FIG. 42) are configured to mate with a corresponding plurality of contacts (not shown) in a plug (e.g., like the plug 10 illustrated in FIG. 41).

Referring to FIG. 2737, the flexible substrate 446 includes a circuit FC (see FIG. 42) configured to facilitate data transmission between the first and second connectors 120 and 122. Referring to FIG. 42, the circuit FC includes conductors or transmission lines TL1-TL8 that connect first contacts C1-1 to C1-8 to second contacts C2-1 to C2-8, respectively. The transmission lines TL1 to TL8 transmit signals between the first contacts C1-1 to C1-8, respectively, and the second contacts C2-1 to C2-8, respectively. As is apparent to those of ordinary skill in the art, the transmission lines TL4 and TL5 transmit a first differential signal pair, the transmission lines TL1 and TL2 transmit a second differential signal pair, the transmission lines TL3 and TL6 transmit a third differential signal pair, and the transmission lines TL7 and TL8 transmit a fourth differential signal pair.

Referring to FIG. 27, the flexible substrate 446 includes one or more twists or coils TW1 and TW2. The coils TW1 and TW2 allow the first and second connectors 120 and 122 to be moved and the distance between the first and second connectors 120 and 122 to change. Nevertheless, referring to FIG. 42, a length "L1" of the flexible substrate 446 remains constant as the coils TW1 and TW2 (see FIG. 27) tighten and/or loosen as, referring to FIG. 30-32, the first and second connectors 120 and 122 are moved. In FIG. 42, for the ease of illustration, the flexible substrate 446 is illustrated as being flat, without the coils TW1 and TW2.

Referring to FIG. 42, the first contacts C1-1 to C1-8 may be connected (e.g., via wires W1-W8) to the contacts P1-1 to P1-8, respectively, of the first connector 120 (see FIG. 27) and the second contacts C2-1 to C2-8 may be connected (e.g., via wires W9-W16) to the contacts P2-1 to P2-8, respectively, of the second connector 122 (see FIG. 27). These connections (e.g., the wires W1-W16) may have a fixed length. The circuit FC extends along a fixed portion of the flexible substrate 446. Thus, the connections between the contacts P1-1 to P1-8 and the contacts P2-1 to P2-8, respectively, (and therefore between the first and second connectors 120 and 122) have a fixed desired length "L2." This provides a consistent electrical distance between the first and second connectors 120 and 122.

Referring to FIG. 27, the desired length "L2" (see FIG. 42) may be characterized as being a controlled electrical distance between the first and second connectors 120 and 122 that facilitates electrical interaction between first and second connectors 120 and 122 and reduces interference (e.g., crosstalk and reflections) between the first and second connectors 120 and 122. The predetermined distance may be configured such the circuit FC (see FIG. 42) facilitates the connection of outlets (e.g., like the outlet 20 illustrated in FIG. 41) to the first and second connectors 120 and 122 in close proximity to one another within the electrical transmission line. Further, the first and second connectors 120 and 122 may be moved to position them to facilitate such connections. For example, the first and second connectors 120 and 122 may be positioned in-line and in-plane with respect to one another, positioned in-line and rotated in-plane with respect to one another, positioned at an angle (e.g., up to an including 90°) with respect to one another, and the like.

Referring to FIG. 12, in some embodiments (e.g., the connector assembly 320), instead of being connected to the contacts P2-1 to P2-8 (see FIG. 42), the second contacts C2-1 to C2-8 (see FIGS. 42-45) may be connected one each to the wires of the cable 134. Thus, an electrical connection may be formed between the first connector 120 and the cable 134.

Connector assemblies (e.g., the connector assemblies 400, 500, 600, 700, 800, and 1000 illustrated in FIGS. 13, 20, 21, 25, 35, and 41, respectively) that include both the first and second connectors 120 and 122 place two electrical connections in close proximity to one another in the same communication channel. This arrangement creates at least two challenges. First, it can increase return loss reflections in the communication channel. When multiple reflections occur within a wavelength of a fundamental frequency of a communications signal along the communication channel, such reflections can cause either constructive or destructive interference with respect to one another. This interference can enhance or diminish the overall reflection as seen further along the communication channel. However, the circuit FC may be configured to determine (or control) the distance between such reflections, which controls the frequency at which such interference reactions occur. Therefore, referring to FIG. 27, by controlling the physical distance and by extension the electrical distance (e.g., the desired length "L2") between the first and second connectors 120 and 122 within the connector assembly, the attributes of such interference can be controlled with respect frequency.

Second, placing two electrical connections in close proximity to one another in the same communication channel can increase crosstalk (e.g., near end crosstalk) onto adjacent transmission lines within the communication channel. Referring to FIG. 27, signals conducted by the first and second connectors 120 and 122 may each be represented as a vector. The vectors each represent a power and phase relationship of a signal at a particular frequency. Interfering signals (e.g., crosstalk) are generally orthogonal (offset by +/−90 degrees in phase) to the fundamental signal. At a connection (or interface) formed by a plug and an outlet (referred to as a "plug/outlet interface"), the crosstalk may be represented as a sum of crosstalk generated by both the plug and the outlet. Typical plug/outlet interfaces formed by data communication connectors are designed such that the crosstalk caused by the plug (typically referred to as "offending crosstalk") is equal and opposite to crosstalk caused by the outlet (typically referred to as "compensated crosstalk"). When a second plug/outlet interface is placed in near proximity to the first plug/outlet interface, the resulting interaction of the multiple connections can cause undesirable crosstalk behavior. This is due primarily to the phase offset of one connection to the other. Referring to FIG. 42, the circuit FC may implement one or more various methods of compensating near end crosstalk.

Figure 43:
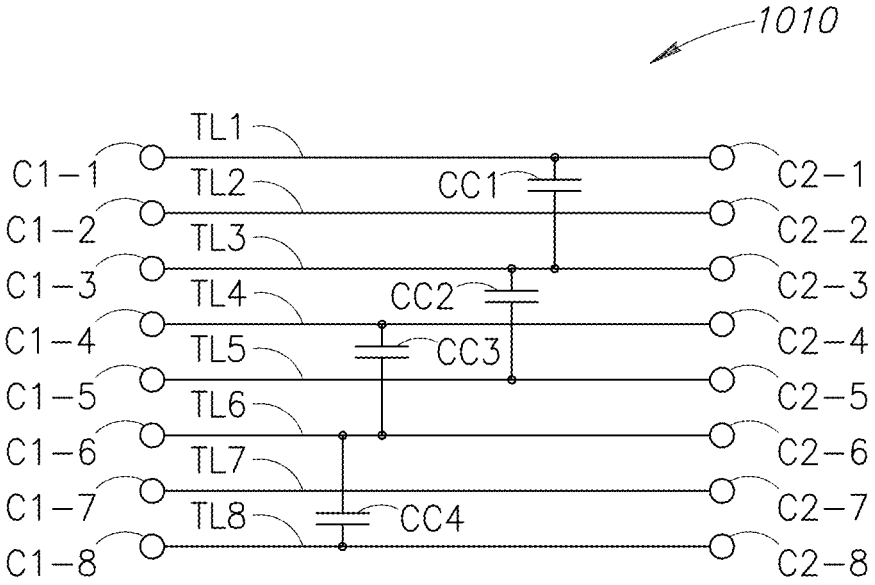
FIG. 43 is a block diagram of a first embodiment of the electrical circuit that may be included on the flexible substrate.

FIG. 43 is a diagram of a first embodiment of an electrical circuit 1010 that may be used to implement the circuit FC (see FIG. 42). The electrical circuit 1010 may cancel electromagnetic interference (e.g., crosstalk) within the connector assembly (e.g., one of the connector assemblies 400, 500, 600, 700, 800, and 1000 illustrated in FIGS. 13, 20, 21, 25, 35, and 41, respectively). In other words, the electrical circuit 1010 may include compensation components CC1-CC4 (e.g., capacitors, inductors, and the like) positioned along the transmission lines TL1-TL8 at fixed and predetermined distances within the connector assembly (e.g., one of the connector assemblies 400, 500, 600, 700, 800, and 1000 illustrated in FIGS. 13, 20, 21, 25, 35, and 41, respectively). The placement and arrangement of the compensation components improve crosstalk cancelation within the connector assembly.

Referring to FIG. 43, the electrical circuit 1010 is configured to compensate for this undesirable crosstalk behavior. For example, the compensation components CC1-CC4 may add offending and/or compensating crosstalk to adjust the resultant phase of all the interactions and improve the efficiency of crosstalk cancelation. The magnitude and phase of the compensation components CC1-CC4 may be dependent on the particular magnitude and phase relationship of the other connections in the system.

For the electrical circuit 1010 to work effectively, it may beneficial to control the phase relationship between the first and second connectors 120 and 122. There is a direct relationship between the physical distance and electrical phase shift between the first and second connectors 120 and 122. Therefore, the flexible substrate 446 fixes the physical distance (at the desired length "L2") between the first and second connectors 120 and 122.

Typically, compensation components are positioned symmetrically (or midway) between two connections. However, in the electrical circuit 1010, at least some of the compensation components CC1-CC4 may be placed closer to one of the first and second connectors 120 and 122. This placement may help offset the phase and improve efficiency under certain circumstances.

The compensation components CC1-CC4 typically capacitively couple differential pairs of two or more signal paths. Inductive elements may also be included to affect the phase relationships of such coupling(s). In the embodiment illustrated in FIG. 43, the compensation component CC1 capacitively couples the transmission lines TL1 and TL3 together and is positioned closer to the second contacts C2-1 to C2-8. The compensation component CC2 capacitively couples the transmission lines TL3 and TL5 together. The compensation component CC3 capacitively couples the transmission lines TL4 and TL6 together. The compensation component CC4 capacitively couples the transmission lines TL6 and TL8 together and is positioned closer to the first contacts C1-1 to C1-8.

Figure 44:
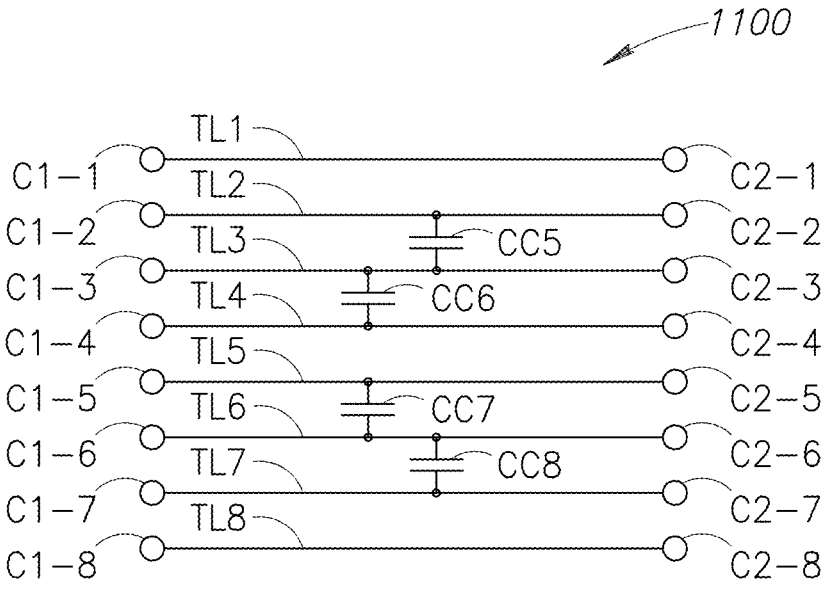
FIG. 44 is a block diagram of a second embodiment of the electrical circuit that may be included on the flexible substrate.

FIG. 44 is a diagram of a second embodiment of an electrical circuit 1100 that may be used to implement the circuit FC (see FIG. 42). In the electrical circuit 1100, a compensation component CC5 capacitively couples the transmission lines TL2 and TL3 together. A compensation component CC6 capacitively couples the transmission lines TL3 and TL4 together. A compensation component CC7 capacitively couples the transmission lines TL5 and TL6 together. A compensation component CC8 capacitively couples the transmission lines TL6 and TL7 together.

Figure 45:
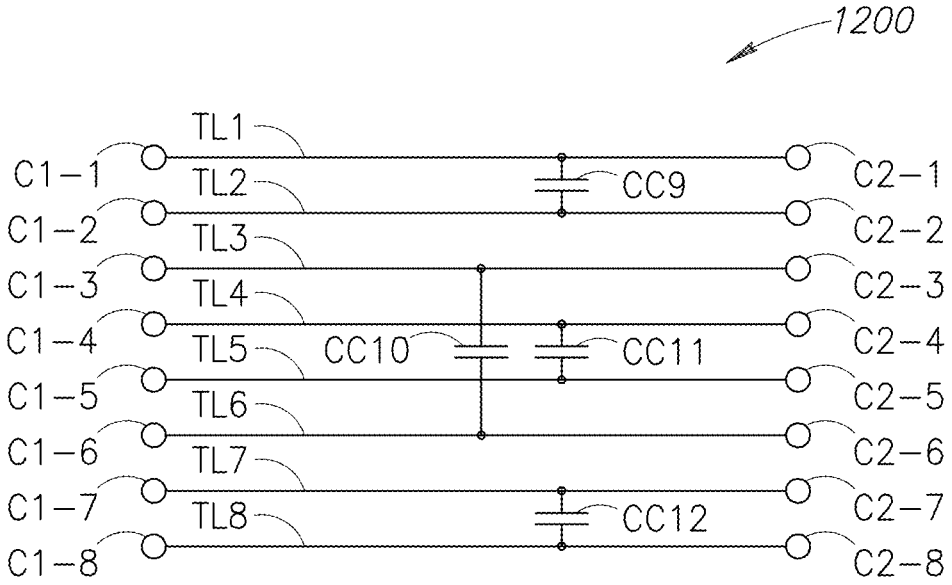
FIG. 45 is a block diagram of a third embodiment of the electrical circuit that may be included on the flexible substrate.

FIG. 45 is a diagram of a third embodiment of an electrical circuit 1200 that may be used to implement the circuit FC (see FIG. 42). In the electrical circuit 1200, a compensation component CC9 capacitively couples the transmission lines TL1 and TL2 together. A compensation component CC10 capacitively couples the transmission lines TL3 and TL6 together. A compensation component CC11 capacitively couples the transmission lines TL4 and TL5 together. A compensation component CC12 capacitively couples the transmission lines TL7 and TL8 together.

Optionally, referring to FIG. 43, the electrical circuit 1010 may also include the compensation components CC9-CC12 (see FIG. 45). By way of yet another example, referring to FIG. 44, the electrical circuit 1100 may also include the compensation components CC9-CC12 (see FIG. 45).

Optionally, shielding (not shown) configured to help prevent crosstalk may be included inside the connector assembly (e.g., one of the connector assemblies 400, 500, 600, 700, 800, and 1000 illustrated in FIGS. 13, 20, 21, 25, 35, and 41, respectively).

While many of the connector assemblies described above have been illustrated and described as being mounted inside a wall plate (e.g., the wall plate 102 illustrated in FIGS. 1-4B and 6, the wall plate 202 illustrated in FIGS. 7-13, 19, 21, and 22, the wall plate 702 illustrated in FIGS. 23, 24, and 33-38, and the like), in alternate implementations, the connector assemblies may be mounted inside a patch panel or another structure (e.g., a conference table, a computer housing, a modular office wall, a piece of furniture, and the like).

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A connector assembly comprising:

a ball-shaped housing;

a first communication connector movably connected to the ball-shaped housing;

a second communication connector movably connected to the ball-shaped housing, the second communication connector being movable with respect to the first communication connector, the first communication connector being movable with respect to the second communication connector; and a flexible circuit board positioned inside the ball-shaped housing and connecting the first communication connector to the second communication connector, the flexible circuit board comprising a plurality of transmission lines and a plurality of compensation components, the plurality of transmission lines conducting a plurality of differential signals between the first and second communication connectors, the plurality of compensation components each coupling a first one of the plurality of transmission lines to a different second one of the plurality of transmission lines, the flexible circuit board being configured to be coiled into one or more coils, the one or more coils at least one of tightening and loosening to maintain a connection between the first and second communication connectors as at least one of the first and second communication connectors is moved.

2. The connector assembly of claim 1 for use with a wall plate comprising an opening, wherein the ball-shaped housing is configured to be received inside the opening and to be moveable with respect thereto.

3. The connector assembly of claim 1, wherein each of the first and second communication connectors is an outlet constructed according to a RJ-45 standard or a plug constructed according to the RJ-45 standard.

4. A connector assembly comprising:

an outer shell with a first opening and a second opening spaced apart from the first opening;

a first cover having a first portion positioned inside the first opening, a first gap being defined between the first portion and the outer shell within the first opening, the first cover being movable within the first opening with respect to the outer shell;

a second cover having a second portion positioned inside the second opening, a second gap being defined between the second portion and the outer shell within the second opening, the second cover being movable within the second opening with respect to the outer shell, the first and second covers being movable independently with respect to one another;

a first communication connector attached to the first cover and moveable therewith as a first unit, the first communication connector being configured to form a first communication connection with a first external communication connector; and a second communication connector attached to the second cover and moveable therewith as a second unit, the second communication connector being configured to form a second communication connection with a second external communication connector.

5. The connector assembly of claim 4, wherein each of the first and second communication connectors is either an outlet constructed according to a RJ-45 standard or a plug constructed according to the RJ-45 standard.

6. The connector assembly of claim 4, wherein each of the first and second communication connectors is a fiber optic connector.

7. The connector assembly of claim 4, further comprising:

a wall plate comprising a socket, the outer shell having a spherical shape configured to be received inside the socket and to be rotated therein.

8. A connector assembly comprising:

an outer shell;

a first cover connected to the outer shell by a first swivel-type connection;

a first communication connector attached to the first cover and moveable therewith as a first unit, the first communication connector being configured to form a first communication connection with a third communication connector;

a second cover connected to the outer shell by a second swivel-type connection, the first and second covers being movable independently with respect to one another; and a second communication connector attached to the second cover and moveable therewith as a second unit, the second communication connector being configured to form a second communication connection with a fourth communication connector.

9. The connector assembly of claim 8, further comprising:

a wall plate comprising a socket, the outer shell having a spherical-shape configured to be received inside the socket and to be rotated therein.

10. An assembly for use with a cable and a second communication connector, the assembly comprising:

a connector assembly comprising a first communication connector that is connectable to the cable, the first communication connector being configured to form a communication connection between the cable and the second communication connector; and a wall plate comprising an opening configured to receive the connector assembly, the connector assembly being selectively rotatable about both a first axis of rotation and a second axis of rotation within the opening to position the first communication connector, the first axis of rotation being different from the second axis of rotation.

11. The assembly of claim 10, wherein the connector assembly comprises a flexible substrate that connects the first communication connector to the cable, the flexible substrate being configured to be coiled into one or more coils, the one or more coils at least one of tightening and loosening to maintain a communication connection between the first communication connector and the cable when the connector assembly is rotated within the opening.

12. The assembly of claim 10, wherein the first communication connector is an outlet constructed according to a RJ-45 standard or a plug constructed according to the RJ-45 standard.

13. The assembly of claim 10, wherein the connector assembly comprises a housing with a track, and the first communication connector is mounted on the track and is slidable thereupon relative to the housing.

14. The assembly of claim 10, wherein the first communication connector is a fiber optic connector.

15. A connector assembly comprising:

an outer shell with a first opening, the outer shell having a track formed therein, the track being spaced apart from the first opening;

a first cover having a first portion positioned inside the first opening, a first gap being defined between the first portion and the outer shell within the first opening, the first cover being movable within the first opening with respect to the outer shell;

a first communication connector attached to the first cover and moveable therewith as a first unit, the first communication connector being configured to form a first communication connection with a first external communication connector; and a second communication connector mounted on the track and being slidable thereupon with respect to the outer shell.

16. The connector assembly of claim 15, wherein each of the first and second communication connectors is either an outlet constructed according to a RJ-45 standard or a plug constructed according to the RJ-45 standard.

17. The connector assembly of claim 15, wherein each of the first and second communication connectors is a fiber optic connector.

18. The connector assembly of claim 15, further comprising:

a wall plate comprising a socket, the outer shell having a spherical shape configured to be received inside the socket and to be rotated therein.

19. A connector assembly comprising:

an outer shell with a first opening;

a first cover having a first portion positioned inside the first opening, a first gap being defined between the first portion and the outer shell within the first opening, the first cover being movable within the first opening with respect to the outer shell; and a first communication connector attached to the first cover and moveable therewith as a first unit, the first communication connector being configured to form a first communication connection with a first external communication connector; and a wall plate comprising a socket, the outer shell having a spherical shape configured to be received inside the socket and to be rotated therein.

20. The connector assembly of claim 19 for use with a cable, wherein the first communication connector is directly connectable to the cable and configured to form a communication connection between the cable and the first external communication connector.

21. The connector assembly of claim 19, wherein the first communication connector is either an outlet constructed according to a RJ-45 standard or a plug constructed according to the RJ-45 standard.

22. The connector assembly of claim 19, wherein the first communication connector is a fiber optic connector.

23. The connector assembly of claim 19, wherein the outer shell has a track formed therein and spaced apart from the first opening, and the connector assembly further comprises:

a second communication connector mounted on the track and being slidable on the track with respect to the outer shell.

* * * * *